US009089737B2

(12) United States Patent
Giannelli et al.

(10) Patent No.: US 9,089,737 B2
(45) **Date of Patent: *Jul. 28, 2015**

(54) EXERCISE APPARATUS AND METHOD WITH SELECTIVELY VARIABLE STABILIZATION

(75) Inventors: Raymond Giannelli, Franklin, MA (US); Scott Lee, Pomfret, CT (US); Arnold Gillen, Faribault, MN (US)

(73) Assignee: Cybex International, Inc., Medway, MA (US)

( * ) Notice: Subject to any disclaimer, the term of this patent is extended or adjusted under 35 U.S.C. 154(b) by 852 days.

This patent is subject to a terminal disclaimer.

(21) Appl. No.: 13/079,977

(22) Filed: Apr. 5, 2011

(65) Prior Publication Data

US 2011/0183816 A1 Jul. 28, 2011

Related U.S. Application Data

(63) Continuation of application No. 12/340,310, filed on Dec. 19, 2008.

(60) Provisional application No. 61/015,917, filed on Dec. 21, 2007.

(51) Int. Cl.
*A63B 21/00* (2006.01)
*A63B 21/062* (2006.01)
(Continued)

(52) U.S. Cl.
CPC ..... *A63B 21/062* (2013.01); *A63B 21/00079* (2013.01); *A63B 21/1484* (2013.01);
(Continued)

(58) Field of Classification Search
USPC ..... 482/51, 55–56, 70, 92–94, 97–103, 482/133–139
IPC ..... A63B 21/00,21/062, 71/00
See application file for complete search history.

(56) References Cited

U.S. PATENT DOCUMENTS 4,603,855 A 8/1986 Sebelle
4,709,918 A 12/1987 Grinblat
(Continued)

FOREIGN PATENT DOCUMENTS

DE 198 01 672 A1 11/1998
EP 1 125 599 A2 8/2001
(Continued)

OTHER PUBLICATIONS

Mar. 9, 2010 Office Action in U.S. Appl. No. 12/340,345.
(Continued)

*Primary Examiner* — Oren Ginsberg
(74) *Attorney, Agent, or Firm* — Novak Druce Connolly Bove + Quigg LLP

(57) ABSTRACT

Exercise apparatus and method with selectively variable stabilization enabling a user to progressively increase his/her core body muscular strength. In various embodiments, the exercise apparatus includes a resistance cabling system providing a user defined line of motion, and a partial stabilizer pad being adjustably positionable offset from the line of motion, wherein the user's core body is positionable against the pad and required to resist the torque created by the offset. The user can progressively increase the distance between the line of motion and partial stabilizer pad, in order to progressively increase the force which the user's core body must resist to maintain an upright stature. In this way, the user can progressively, over time, increase his or her core body strength. A vertically and rotatably adjustable handle/arm assembly, resistance cabling and pulley assembly, and an overall exercise apparatus having a relatively small footprint but allowing multiple variable exercise routines, are also provided.

30 Claims, 21 Drawing Sheets

(51) Int. Cl.

| | |
|---|---|
| ***A63B 71/00*** | (2006.01) |
| ***A63B 23/035*** | (2006.01) |
| ***A63B 23/12*** | (2006.01) |

(52) U.S. Cl.

CPC ..... *A63B21/154* (2013.01); *A63B 21/156* (2013.01); *A63B 23/03533* (2013.01); *A63B 23/1245* (2013.01); *A63B 2208/0204* (2013.01); *A63B 2208/0233* (2013.01); *A63B 2208/0252* (2013.01); *A63B 2208/0261* (2013.01); *A63B 2225/093* (2013.01); *A63B 2225/107* (2013.01)

(56) References Cited

U.S. PATENT DOCUMENTS

| | | | | |
|---|---|---|---|---|
| 4,721,303 | A | 1/1988 | Fitzpatrick | |
| 4,826,157 | A | 5/1989 | Fitzpatrick | |
| 4,898,381 | A | 2/1990 | Gordon | |
| 5,123,886 | A | 6/1992 | Cook | |
| 5,387,168 | A | 2/1995 | Bostic | |
| 5,616,111 | A | 4/1997 | Randolph | |
| 5,807,219 | A | 9/1998 | Webber et al. | |
| 5,971,896 | A | 10/1999 | Giannelli et al. | |
| 5,989,165 | A | 11/1999 | Giannelli et al. | |
| 5,997,447 | A | 12/1999 | Giannelli et al. | |
| 6,071,216 | A | 6/2000 | Giannelli et al. | |
| 6,142,917 | A | 11/2000 | Giannelli et al. | |
| 6,152,864 | A | 11/2000 | Giannelli et al. | |
| 6,238,323 | B1 | 5/2001 | Simonson | |
| 6,254,516 | B1 | 7/2001 | Giannelli et al. | |
| 6,422,980 | B1 | 7/2002 | Simonson | |
| 6,443,877 | B1 | 9/2002 | Hoecht et al. | |
| 6,447,430 | B1 | 9/2002 | Webb | |
| 6,488,612 | B2 | 12/2002 | Sechrest et al. | |
| 6,705,976 | B1 | 3/2004 | Piane, Jr. | |
| 6,770,015 | B2 | 8/2004 | Simonson | |
| 7,179,209 | B2 | 2/2007 | Sechrest et al. | |
| 7,503,882 | B2 | 3/2009 | Sechrest et al. | |
| 7,575,538 | B1 | 8/2009 | Clark | |
| 7,604,576 | B2 | 10/2009 | Drechsler | |
| 7,608,024 | B2 | 10/2009 | Sechrest et al. | |
| 7,625,321 | B2 | 12/2009 | Simonson et al. | |
| 7,815,552 | B2 * | 10/2010 | Dibble et al. | 482/92 |
| 2002/0039954 | A1 * | 4/2002 | Simonson | 482/99 |
| 2002/0091043 | A1 | 7/2002 | Rexach | |
| 2003/0017918 | A1 | 1/2003 | Webb et al. | |
| 2003/0045406 | A1 | 3/2003 | Stone | |
| 2003/0060343 | A1 | 3/2003 | Sechrest et al. | |
| 2004/0214697 | A1 | 10/2004 | Gerschefske et al. | |
| 2005/0049121 | A1 | 3/2005 | Dalebout et al. | |
| 2006/0100069 | A1 | 5/2006 | Dibble et al. | |
| 2006/0189462 | A1 | 8/2006 | Pearson et al. | |
| 2007/0037674 | A1 | 2/2007 | Finn et al. | |
| 2008/0051267 | A1 | 2/2008 | Ish | |
| 2008/0176716 | A1 * | 7/2008 | Boren | 482/51 |
| 2008/0300116 | A1 | 12/2008 | Eder | |
| 2009/0170668 | A1 | 7/2009 | Giannelli et al. | |
| 2009/0170669 | A1 | 7/2009 | Giannelli et al. | |
| 2009/0170675 | A1 | 7/2009 | Giannelli et al. | |
| 2009/0181833 | A1 | 7/2009 | Cassidy et al. | |
| 2010/0016129 | A1 | 1/2010 | Chou | |

FOREIGN PATENT DOCUMENTS

| | | | |
|---|---|---|---|
| FR | 2 585 958 | A1 | 2/1987 |
| SU | 1743620 | A1 | 6/1992 |
| WO | WO 01/14016 | A2 | 3/2001 |

OTHER PUBLICATIONS

Oct. 28, 2010 Office Action in U.S. Appl. No. 12/340,345.
"PFT-200 Functional Trainer", 2003, Paramount Fitness Corp.
Non Final Office Action dated Mar. 9, 2010 in U.S. Appl. No. 12/340,345.
Non Final Office Action dated Feb. 4, 2010 in U.S. Appl. No. 12/340,399.
Non Final Office Action dated Apr. 18, 2011 in co-pending and commonly owned U.S. Appl. No. 12/340,310.
Invitation to Pay Additional Fees and International Search Report in related PCT/US2008/087772, mailed Apr. 29, 2009.
Jul. 20, 2009 International Search Report and Written Opinion in related application PCT/US2008/087772.
Non-Final Office Action dated Apr. 25, 2010 in co-pending and commonly owned U.S. Appl. No. 12/340,310.
"Selectorized Duals" Personal Pulley System, HD 1900, *Hoist Fitness Systems*, Brochure, Copyright 2002, 1 pg.
"The New Dual Adjustable Pulley System", *Life Fitness*, Available, on information and belief, at least as early as Aug. 2000, 1 pg.
"Cable Column", *Free Motion Fitness Inc.*, Brochure, Available, on information and belief, at least as early as Feb. 2002, 1 pg.
"Cable Crossover Club Series", *Life Fitness*, Internet page printed Oct. 7, 2002, 1 pg.
"H4600" Multi-gym, *Hoist Fitness Systems*, Brochure, Copyright Sep. 2001, 2 pgs.
"The Ultimate Group Workout is Here", Hoist Fitness Systems, Advertisement, Available, on information and belief, at least as early as Feb. 2001, 1 pg.
"Coach Training and Certificate Program", *Group Free Motion*, Instructor Curriculum, Copyright 2001, 88 pgs.
"Free Motion Group Training Manuals", *Free Motion Fitness, Inc.*, Copyright 2001, 50 pgs.
"Free Motion Facility Manual", *Free Motion Fitness, Inc.*, Copyright 2001, 43 pgs.
The Merriam-Webster Dictionary, http://www.merriam-webster.com/dictionary/point, definition of "point".
"Cybex Eagle Selectorized Strength, Cybexperience", 2007 Cybex International.
"Cybex FT-360S Functional Trainer", 2008, Cybex International.
"Cybex Plate Loaded & Free Weights" 2009 Cybex International.
"Cybex Plate Loaded, Free Weights, & Modular" 2009 Cybex International.
Lifestyle "Vision ST200 Functional Trainer" 2009 Lifestylefitness.com.
"Cybex VR1 Selectorized Strength, Cybexceptional", 2007 Cybex International.
"Cybex VR3 Selectorized Strength, Cybexextraordinary", 2007 Cybex International.
Final Office Action dated Nov. 9, 2010 in U.S. Appl. No. 12/340,399.
Final Office Action dated Jan. 7, 2011 in U.S. Appl. No. 11/340,310.
Final Office Action dated Jun. 13, 2011 in U.S. Appl. No. 12/340,345.
Non-Final Office Action dated Jul. 22, 2011 in U.S. Appl. No. 13/079,977.

* cited by examiner

EXERCISE APPARATUS AND METHOD WITH SELECTIVELY VARIABLE STABILIZATION

RELATED APPLICATIONS

This application is a continuation of U.S. Ser. No. 12/340,310 filed 19 Dec. 2008, and claims priority under 35 U.S. Section 119 to U.S. Provisional Patent Application Ser. No. 61/015,917 entitled Exercise Apparatus with Selectively Variable Stabilization, filed Dec. 21, 2007, the disclosures of which are incorporated herein by reference in their entirety.

BACKGROUND

Multi-functional physical exercise apparati have been designed in the past to incorporate a variety of different sub-assemblies into a single machine which enable the user to perform a variety of different exercises. These conventional machines typically provide a limited number of available exercise routines for specific muscle groups, and the routines themselves are often limited in the ranges and types of motion that the user may perform. Specifically, these routines generally limit the user to exercising one particular set of muscles at a time.

SUMMARY OF THE INVENTION

The present invention relates to an exercise apparatus and method for performing multiple exercise routines at a single machine for enhancing core body strength, and more particularly by providing a selectively variable and partial stabilization of the user's core body (trunk or torso) while performing such exercise routines. By varying the location of partial stabilization with respect to the user's trunk, the user can increase his/her core body musculature strength. This core body strength is what is needed in performing everyday activities, such as lifting of a heavy box, where the body must compensate for the torque generated by the offset (distance) between the weight (box) and the user's torso.

In accordance with one embodiment, an exercise apparatus comprises a resistance cabling system providing a user-defined line of motion, a partial stabilizer pad being adjustably positionable offset from the line of motion, wherein the user's core body is positionable against the pad and required to resist the torque created by the offset.

In one alternative, a handle is provided for grasping by the user, the handle being connected to one end of a resistance cable that (when pushed or pulled) defines the line of motion. The handle is positionable at multiple selected vertical and rotational positions on the apparatus, enabling the user to define a line of pulling or pushing motion at each selected position. The partial stabilizer pad is positionable at multiple selected (e.g. incremental) vertical positions offset from the line of motion. A second handle, having an independent resistance cabling system, is also provided for use at the same time as the first handle for coordinated pushing (or pulling) movement by both arms simultaneously.

In one alternative, the user can progressively increase the distance (e.g. vertical height) between the line of motion and partial stabilizer pad, in order to progressively increase the force which the user's core body must resist. In this way, the user can progressively, over time, increase his or her core body strength.

In one alternative embodiment the apparatus includes:

a stationary frame;

at least one handle attached to a resistance cable, the handle being grasped by the user to define the line of motion;

the partial stabilizer pad being adjustably mounted to the frame for varying the position of the pad with respect to the handle.

In one alternative embodiment:

the handle is connected to one end of a resistance cable that, when pushed or pulled, defines the line of motion.

In one alternative embodiment:

the handle is positionable at multiple selected vertical positions on the apparatus, enabling the user to define a line of pulling or pushing motion in each selected position.

In one alternative embodiment:

the partial stabilizer pad is positionable at multiple selected vertical positions offset from the line of motion.

In one alternative embodiment:

the frame has a vertically adjustable mounting mechanism for the partial stabilizer pad.

In one alternative embodiment:

the mounting mechanism extends forwardly from a front face of the frame, and is centrally disposed between two independent handle and resistance cable assemblies.

In one alternative embodiment:

the mounting mechanism for the partial stabilizer pad includes an adjustable forward extender and an adjustable height extender, pivotally connected to each other to provide a range of vertical positioning of the pad.

In one alternative embodiment:

the at least one handle is rotatably mounted on the apparatus, providing select positioning of the handle around a circumference.

In one alternative embodiment:

the at least one handle is vertically adjustably positionable on the apparatus.

In one alternative embodiment:

the at least one handle is rotatably and vertically adjustably positionable on an upright member of the frame.

In one alternative embodiment:

the mounting mechanism can be collapsed.

In another one embodiment, a method is provided comprising:

providing an exercise apparatus comprising a resistance cabling system providing a user defined line of motion, and a partial stabilizer pad being adjustably positionable offset from the line of motion;

a user positioning a select portion of his/her core body against the partial stabilizer pad while extending the cabling system to define the user defined line of motion and strengthening the user's core body musculature by resisting the torque created by the offset between the pad and the line of motion.

In one alternative embodiment, the method includes:

providing a handle at the end of a resistance cable, wherein the handle is grasped by the user to define the line of motion.

In one alternative embodiment, the method includes:

providing the handle at multiple selected vertical positions, enabling the user to adjust the amount of offset between the line of motion and the partial stabilizer pad.

In one alternative embodiment, the method includes:

providing a rotatable handle, enabling the user to adjust the offset between the line of motion and the stabilizer pad.

In one alternative embodiment, the method includes:

providing a handle positionable in multiple selected vertical positions and multiple selected rotatable positions, wherein the user selects a vertical position and a rotatable position to adjust the amount of offset between the line of motion and the stabilizer pad.

In one alternative embodiment, the method includes:

progressively increasing the amount of offset.

In another embodiment, an exercise apparatus is provided comprising:

a frame having one or more upright supports having a vertical length;

a handle assembly being mounted on at least one of the upright supports, the handle assembly and the upright support being adapted for selective movement of the assembly to any one of a multiplicity of fixed positions along the vertical length of the support;

the handle assembly having a grip member mounted at a distal end of the handle assembly and interconnected to a weight resistance mechanism for pulling engagement by a user;

the handle assembly being adapted for rotation on the support around a horizontal axis relative to vertical wherein the handle assembly is fixedly positionable at any one of a multiplicity of selected positions around the horizontal axis.

In one alternative embodiment, the apparatus comprises:

a pair of handle assemblies each mounted on a separate one of a pair of upright supports;

wherein each of the handle assemblies have a grip member mounted at a distal end of the handle assemblies; and, wherein each of the grips is interconnected to a separate weight resistance mechanism, each weight resistance mechanism being separately adjustable to select a degree of weight resistance separate or different from the other grip.

In one alternative embodiment, the apparatus further comprises;

a pair of handle assemblies each mounted on a separate one of a pair of upright supports;

wherein each handle assembly is separately rotatable around a separate horizontal axis and separately fixedly positionable at any one of a multiplicity of selected positions around their respective horizontal axes;

wherein the separate horizontal axes are disposed at an angle to each other.

In one alternative embodiment, the separate horizontal axes are disposed at an angle of between about 60 and about 120 degrees relative to each other.

In another embodiment, an exercise apparatus is provided comprising:

a frame having a pair of upright supports each having a vertical length;

a pair of handle assemblies, each being mounted on a separate one of the upright supports, the handle assemblies and the upright supports being adapted for selective movement of the assembly to any one of a multiplicity of fixed positions along the vertical lengths of the supports;

the handle assemblies each having a grip member mounted at a distal end of the handle assemblies;

each grip member being interconnected to a separate weight resistance mechanism for pulling engagement by a user;

each weight resistance mechanism being separately adjustable to select a degree of weight resistance separate or different from the other weight resistance mechanism.

In one alternative embodiment, the handle assemblies are each adapted for rotation on the support around a separate horizontal axis relative to vertical, the handle assemblies being fixedly positionable at any one of a multiplicity of selected positions around their respective separate horizontal axes.

In one alternative embodiment, the separate horizontal axes are disposed at an angle relative to each other.

In another embodiment, an exercise apparatus is provided comprising:

a frame having one or more upright supports having a vertical length;

a handle assembly being mounted on at least one of the upright supports, the handle assembly and the upright support being adapted for selective movement of the assembly to any one of a multiplicity of fixed positions along the vertical length of the support;

the handle assembly having a grip member mounted at a distal end of the handle assembly and interconnected to a weight resistance mechanism for pulling engagement by a user;

a counterweight mechanism interconnected to the handle assembly, to offset the weight of the handle assembly.

In one alternative embodiment, the apparatus comprises:

a pair of handle assemblies each mounted on a separate one of a pair of upright supports;

each of the handle assemblies being interconnected to a separate counterweight mechanism.

In one alternative embodiment, the counterweight mechanism comprises a counterweight and a cable mounted on one or more pulleys, the cable being interconnected to the handle assembly and the counterweight.

In one alternative embodiment, the handle assembly is adapted for rotation on the support around a horizontal axis relative to vertical, the handle assembly being fixedly positionable at any one of a multiplicity of selected positions around the horizontal axis.

In one alternative embodiment, the handle assemblies are each adapted for rotation on the support around a separate horizontal axis relative to vertical, the handle assemblies being fixedly positionable at any one of a multiplicity of selected positions around their respective separate horizontal axes.

In one alternative embodiment, the separate horizontal axes are disposed at an angle relative to each other.

In another embodiment an exercise apparatus is provided comprising:

a frame having one or more upright supports having a vertical length;

a handle assembly being mounted on at least one of the upright supports, the handle assembly and the upright support being adapted for selective movement of the assembly to any one of a multiplicity of fixed positions along the vertical length of the support;

the handle assembly having a grip member mounted at a distal end of the handle assembly and interconnected to a weight resistance mechanism for pulling engagement by a user;

a pad that is vertically adjustable to one of a plurality of selectable fixed vertical positions, the fixed vertical positions of the pad being arranged to enable the user to access the grip with a first selected portion of the user's body and to simultaneously engage and partially stabilize a second selected portion of the user's body against the pad in opposition to a pulling force exerted by the user on the grip member with the first selected portion of the user's body, wherein the second selected portion is a portion of the user's trunk.

In one alternative embodiment, the pad is mounted to a vertical adjustment assembly that is interconnected to the frame such, the pad being vertically adjustable to engage a plurality of vertically separate portions of the user's trunk.

In one alternative embodiment, the apparatus comprises:

a pair of handle assemblies each mounted on a separate one of a pair of upright supports and vertically adjustable on a respective support;

wherein each of the handle assemblies have a grip member mounted at a distal end of the handle assemblies; and, wherein each of the grip members is interconnected to a separate weight resistance mechanism, each weight resistance mechanism being separately adjustable to select a degree of weight resistance separate or different from the other grip.

In one alternative embodiment, the apparatus comprises:

a pair of handle assemblies each mounted on a separate one of a pair of upright supports;

each of the handle assemblies being interconnected to a separate counterweight mechanism.

In one alternative embodiment, the handle assembly is adapted for rotation on the vertical support around a horizontal axis relative to vertical and wherein the handle assembly is fixedly positionable at any one of a multiplicity of selected positions around the horizontal axis.

In one alternative embodiment, the apparatus comprises:

a pair of handle assemblies each mounted on a separate one of a pair of upright supports;

wherein each handle assembly is separately rotatable around a separate horizontal axis and separately fixedly positionable at any one of a multiplicity of selected positions around their respective horizontal axes; and wherein the separate horizontal axes are disposed at an angle to each other.

In another embodiment an exercise apparatus is provided comprising:

a frame having a pair of upright supports each having a vertical length;

a pair of handle assemblies each mounted on a respective one of the upright supports, each handle assembly and each respective upright support being adapted for selective movement of the handle assembly to any one of a multiplicity of fixed positions along the vertical length of the respective support;

the handle assemblies each comprising an arm having a length, a proximal end mounted on the support at a respective horizontal axis of rotation and having a distal end on which a grip member is mounted for pulling engagement by a user, each grip member being interconnected to a separate weight resistance mechanism;

the handle assemblies being adapted for rotation on their respective vertical supports around their respective horizontal axes relative to vertical; and each handle assembly being separately fixedly positionable at any one of a multiplicity of selected positions around their horizontal axes such that the distal ends of the pair of handle assemblies are fixedly positionable at selected minimum and maximum distances away from each other.

In another embodiment, an exercise apparatus is provided comprising:

a frame interconnecting first and second upright generally vertically disposed supports and first and second weight resistance mechanisms;

a pair of handle assemblies mounted on the upright supports;

the handle assemblies each comprising an arm of selected length, each arm having a grip member mounted at a distal end of the arm, the grip members each being interconnected to a respective one of the weight resistance mechanisms for pulling engagement by a user;

each arm being rotatably mounted at a proximal end to or on their respective supports for rotation around respective first and second generally horizontally disposed axes that are perpendicular to respective first and second generally vertically disposed planes; and wherein the generally vertically disposed planes are disposed at an angle to each other.

In one alternative embodiment, the vertically disposed planes are disposed at an angle to each other of between about 60 and about 120 degrees In another embodiment, an exercise apparatus is provided comprising:

a frame interconnecting first and second upright generally vertically disposed supports, the supports being laterally or horizontally spaced apart from each other on the frame by a selected lateral or horizontal distance;

a pair of handle assemblies mounted on the upright supports, the handle assemblies each comprising an arm of selected length, each arm having a grip member mounted at a distal end of the arm, the grip members each being interconnected to a weight resistance mechanism for pulling engagement by a user;

each arm being rotatably mounted at a proximal end to or on their respective supports for rotation around respective first and second generally horizontally disposed axes that are perpendicular to respective first and second generally vertically disposed planes;

wherein the generally vertically disposed planes are disposed at an angle to each other;

a pad mounted to or on the frame at a position that is disposed within the selected horizontal or lateral distance between the upright supports, the pad being selectively adjustable to any one of a plurality of fixed vertical and horizontal or lateral positions relative to the supports, the fixed positions of the pad being selected to enable the user to access at least one of the grips with a first selected portion of the user's body and to simultaneously engage and partially stabilize a second selected portion of the user's body against the pad in opposition to a pulling force exerted by the user on the grip member with the first second selected portion of the user's body, wherein the second portion is a portion of the user's trunk.

In one alternative embodiment:

each of the grip members is interconnected to a separate weight resistance mechanism;

the separate weight resistance mechanisms being mounted on or to the frame a second selected horizontal or lateral distance from each other;

the pad being mounted to or on the frame at a position that is disposed within the second selected horizontal or lateral distance between the separate weight resistance mechanisms.

In one alternative embodiment, the pad is mounted to or on the frame by an extension mount, the extension mount including a vertical position adjustment mechanism.

In another embodiment, an exercise apparatus is provided comprising:

a frame interconnecting first and second upright generally vertically disposed support and first and second weight resistance mechanisms; each upright support having a vertical length and a handle assembly mounted on each respective support;

the upright supports being adapted for selective movement of the handle assemblies to any one of a plurality of fixed positions along the vertical lengths of the respective supports;

the handle assemblies each having a grip member mounted at a distal end of the handle assemblies, the grip members each being interconnected to a respective one of the weight resistance mechanisms for pulling engagement by a user;

the handle assemblies being rotatably mounted on their respective supports for rotation around respective first and second generally horizontally disposed axes that are perpendicular to respective first and second generally vertically disposed planes;

wherein the generally vertically disposed planes are disposed at an angle to each other.

In one alternative embodiment, the vertically disposed planes are disposed at an angle to each other of between about 60 and about 120 degrees.

In one alternative embodiment, the apparatus further comprises a pad that is selectively adjustable to any one of the fixed vertical positions, the fixed vertical positions of the pad being selected to enable the user to access at least one of the grips with a first selected portion of the user's body and to simultaneously engage and partially stabilize a second selected portion of the user's body against the pad in opposition to a pulling force exerted by the user on the grip member with the first selected portion of the user's body, wherein the second selected portion is a portion of the user's trunk.

In one alternative embodiment:

the handle assemblies each comprise an arm having a length, a proximal end mounted on the support at the respective first and second horizontal axes and a distal end on which the respective grip members are mounted for pulling engagement by the user;

each handle assembly being separately fixedly positionable at any one of a plurality of selected positions around their respective first and second horizontal axes such that the distal ends of the pair of handle assemblies are fixedly positionable at selected minimum and maximum distances away from each other.

In one alternative embodiment, the pad is mounted on a vertical adjustment mechanism that is mounted to the frame at a position between the first and second vertical supports.

In one alternative embodiment, the pad comprises a stop member having a body engaging surface, the stop member and the vertical adjustment mechanism being adapted to selectively position the body engaging surface at any one of a plurality of fixed vertical positions with the body engaging surface facing generally horizontally or laterally away from the front sides of the sub-frames.

In one alternative embodiment, the body engaging surface has a surface area of less than or equal to about 0.5 square feet.

In another embodiment, an exercise apparatus is provided comprising:

a frame;

first and second weight resistance mechanisms mounted on or to the frame;

first and second grip members mounted on or to the frame and interconnected respectively to the first and second weight resistance mechanisms;

a pad mounted to or on the frame, the pad being selectively adjustable to one of a plurality of fixed vertical positions, the fixed vertical positions of the pad being arranged to enable the user to access at least one of the grips with a first selected portion of the user's body and to simultaneously engage and partially stabilize a second selected portion of the user's body against the pad in opposition to a pulling force exerted by the user on the grip member with the first selected portion of the user's body, wherein the second selected portion is a portion of the user's trunk.

In one alternative embodiment, the pad is mounted on or to a vertical adjustment mechanism that is mounted on or to the frame at a horizontal position between the first and second weight resistance mechanisms.

In one alternative embodiment, the pad comprises a stop member having a body engaging surface, the stop member and the vertical adjustment mechanism being adapted to selectively position the body engaging surface at any one of the fixed vertical positions with the body engaging surface facing generally horizontally or laterally away from the front sides of the frame.

In one alternative embodiment, the body engaging surface has a surface area of less than or equal to about 0.5 square feet.

In one alternative embodiment, the body engaging surface has a surface area of less than or equal to about 0.3 square foot.

In one alternative embodiment, the pad is selectively adjustable to one of a plurality of fixed horizontal or lateral positions relative to the frame or the grip members.

In another embodiment, a method of performing an exercise by a user is provided, the method comprising:

mounting first and second weight resistance mechanisms on a frame;

interconnecting the first and second weight resistance mechanisms to grip members that are mounted such that pulling on the grip members by the user creates an opposing weight force to the pulling;

fixedly positioning a pad in any one of a plurality of vertically and horizontally fixed positions relative to the grip members;

selecting the vertically and horizontally fixed positions relative to the grip members such that the user can simultaneously engage at least one grip member with a first portion of the user's body to effect a pulling force on the grip member and simultaneously engage the pad with a second portion of the user's body against the pulling force;

positioning the second portion of the user's body in engagement with the fixedly positioned pad, wherein the second portion is a portion of the user's trunk; and, exerting a pulling force on the grip member with the first portion of the user's body and maintaining the second portion of the user's body in engagement with the pad against the pulling force.

In another embodiment, a method of performing an exercise by a user is provided, the method comprising:

mounting a weight resistance mechanism on a frame;

interconnecting the weight resistance mechanisms to a grip member that is mounted on or to the frame such that pulling on the grip member by the user creates an opposing weight force to the pulling;

fixedly positioning the grip member in any one of a plurality of selected vertically fixed positions;

fixedly positioning a pad in any one of a plurality of vertically and horizontally fixed positions relative to the grip member;

selecting the vertically and horizontally fixed positions relative to the grip member such that the user can simultaneously engage the grip member with a first portion of the user's body to effect a pulling force on the grip member and simultaneously engage the pad with a second portion of the user's body against the pulling force;

positioning the second portion of the user's body in engagement with the fixedly positioned pad, wherein the second portion is a portion of the user's trunk; and, exerting a pulling force on the grip member with the first portion of the user's body and maintaining the second portion of the user's body in engagement with the pad against the pulling force.

In another embodiment, an exercise apparatus is provided comprising:

a frame;

a weight resistance mechanism mounted on or to the frame;

a grip member mounted on or to the frame, the grip member being interconnected to the weight resistance mechanism via a cable supported on one or more pulleys mounted on or to the frame;

a pad mounted to or on the frame, the pad being selectively adjustable to one of a plurality of fixed vertical positions, the fixed vertical positions of the pad being arranged to enable the user to access at least one of the grips with a first selected portion of the user's body and to simultaneously engage a second selected portion of the user's trunk against the pad in opposition to a pulling force exerted by the user on the grip member with the first selected portion of the user's body.

In one alternative embodiment, the apparatus comprises:

an arm mounted on or to the frame, the arm comprising a tube through which the cable extends, the tube having a pair of pulleys rotatably mounted at a distal end of the tube;

a distal end of the cable guided through and supported by the pair of pulleys and being connected to the grip member;

the cable being supported on at least another pulley mounted on or to the frame, a proximal end of the cable being interconnected to the weight mechanism.

In one alternative embodiment, the apparatus comprises:

first and second weight resistance mechanisms mounted on or to the frame;

first and second grip members mounted on or to the frame, each of the grip members being interconnected to a respective one of the weight resistance mechanisms via a respective cable supported on one or more respective pulleys mounted on or to the frame.

In an alternative embodiment, the weight mechanism comprises one or more weight increments interconnected to a weight pulley, the cable engaging the weight pulley.

In one alternative embodiment, the apparatus comprises:

an arm mounted on or to the frame, the arm comprising a tube through which one of the cables extends, the tube having a pair of pulleys rotatably mounted at a distal end of the tube;

a distal end of the one cable being guided through and supported by the pair of pulleys and being connected to a respective grip member;

the one cable being supported on at least another pulley mounted on or to the frame, a proximal end of the one cable being interconnected to the respective weight mechanism.

In an alternative embodiment, the respective weight mechanism comprises one or more weight increments interconnected to a weight pulley, the cable engaging the weight pulley.

In another embodiment, a method of performing an exercise by a user having a limb and a trunk having a vertical length is provided, the method comprising:

stationarily positioning a stop in a first position in engagement with a first selected area of the user's trunk along the length of the user's trunk;

pulling with force on a grip member interconnected to a weight resistance with the user's limb along a line or direction of pulling force that causes the first selected area of the user's trunk to engage the fixed stop in opposition to the pulling force;

adjusting the stop to a second stationary position that engages a second selected area of the user's trunk along the length of the user's trunk;

pulling a second time with force on the grip member with the user's limb along a line or direction of pulling force that causes the second selected area of the user's trunk to engage the fixed stop in opposition to the second pulling force.

BRIEF DESCRIPTION OF THE DRAWINGS

The drawings depict various embodiments of the invention wherein.

DETAILED DESCRIPTION

Apparatus Overview

Before describing in detail the various sub-assemblies of one embodiment of the apparatus of the present invention, a general overview will be provided. For ease of description, the left and right side frame elements and left and right side rotatable arm/handle assemblies are generally referred to as sub-elements a (left) and b (right) and are given the same reference number. The apparatus is essentially symmetrical, with each of the left and right side frame, rotatable arm/handle assemblies, cable and pulley assemblies and weight stacks being the same. Thus, in some instances the sub-assembly on only one side will be described, it being clear from the drawings and reference numbers that the other side sub-assembly is the mirror image.

Figure 1:
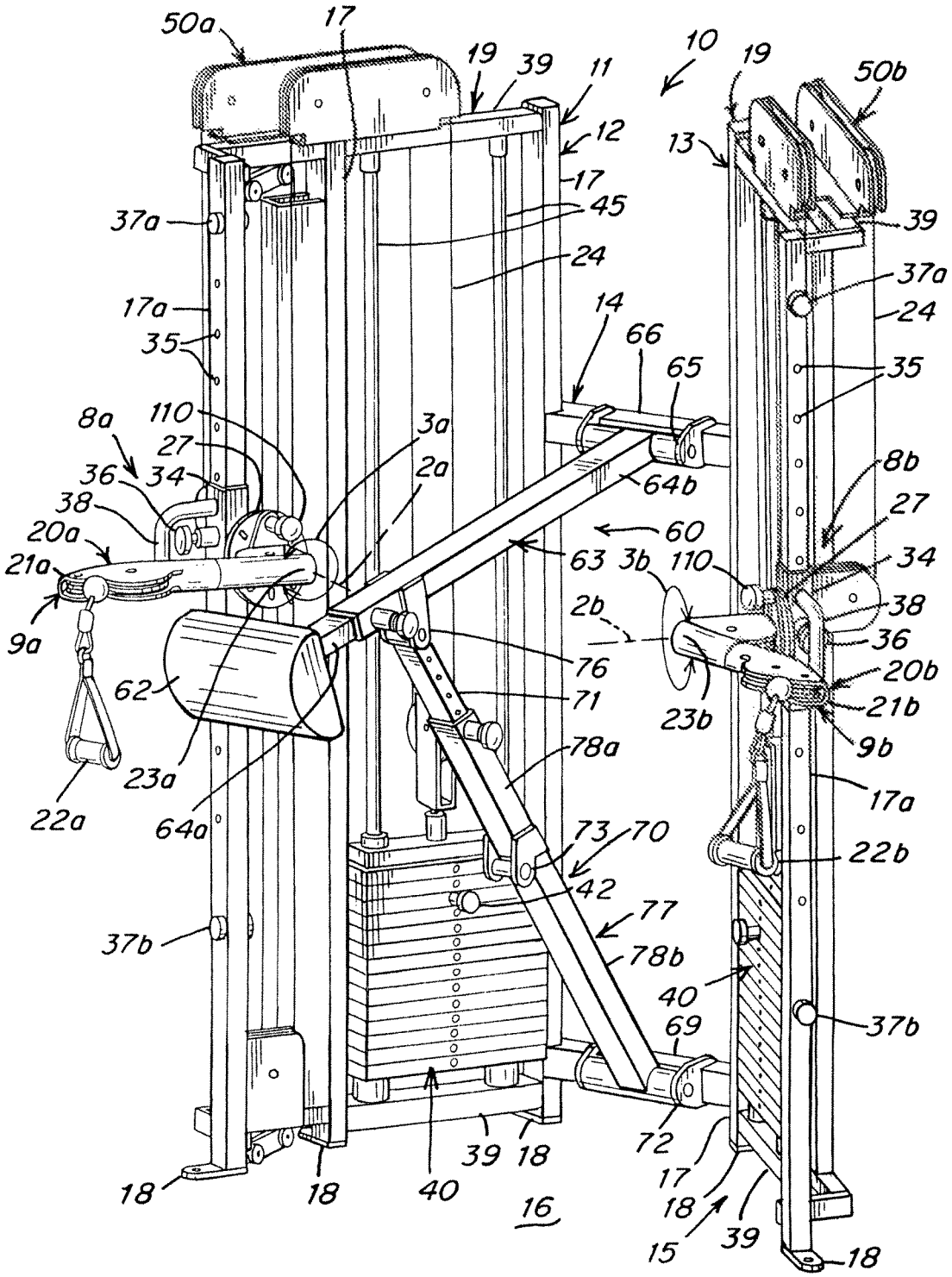
FIG. 1 is a front perspective view of an apparatus according to the one embodiment of the invention.

FIG. 1 is an overall view of a functional trainer (multi-exercise) apparatus 10 according to one embodiment of the invention. A pair of left and right handle/arm assemblies 8*a*, 8*b* are both vertically movable and adjustable on left and right sides 12, 13 of a stationary frame 11, and rotatable around horizontal axes 2*a*, 2*b*, respectively, the axes 2*a*, 2*b* being generally perpendicular to the vertical direction. The handle/arm assemblies 8 are preferably fixedly positionable at incremental angular positions around their respective horizontal axis 2. Such rotatability around a horizontal axis 2 at selected fixed positions enables the distal ends 9*a*, 9*b* of the arms 20*a*, 20*b*, at which points the hand grips 22*a*, 22*b* are mounted at the start of an exercise, to be fixedly and adjustably positionable at selectively variable distances and locations away from/relative to each other. As shown for example in FIG. 2, at one extreme the distal ends 9 of the assemblies are positioned from each other at a minimum distance D1 and at the other extreme at a maximum distance of D2. As can readily be imagined, the assemblies can be fixedly positioned at any one of a multiplicity of selected positions in between the two extreme positions shown in FIG. 2 such that the distance between the ends 9 varies in distance anywhere between the minimum D1 and maximum D2 distances.

The upright stationary frame 11 includes two vertical frame elements on which the rotatable arms are mounted, a left side frame 12 and a right side frame 13, disposed on either side of a rear frame 14. The three frame elements form a generally truncated triangular shape, framing a generally triangular open area 16 in front of the machine where the user is positioned. The rear frame 14 forms one truncated angle of the triangle, with the left and right side frames 11 and 13 extending forwardly and outwardly from the rear frame 14 at an angle X relative to each other of greater than 90° but less than 180° between the left and right side frames, e.g. of between about 60 and about 120 degrees. The relative width, length and angle between the frame members can be varied, so long as they provide a stable and generally open front area.

Figure 2:
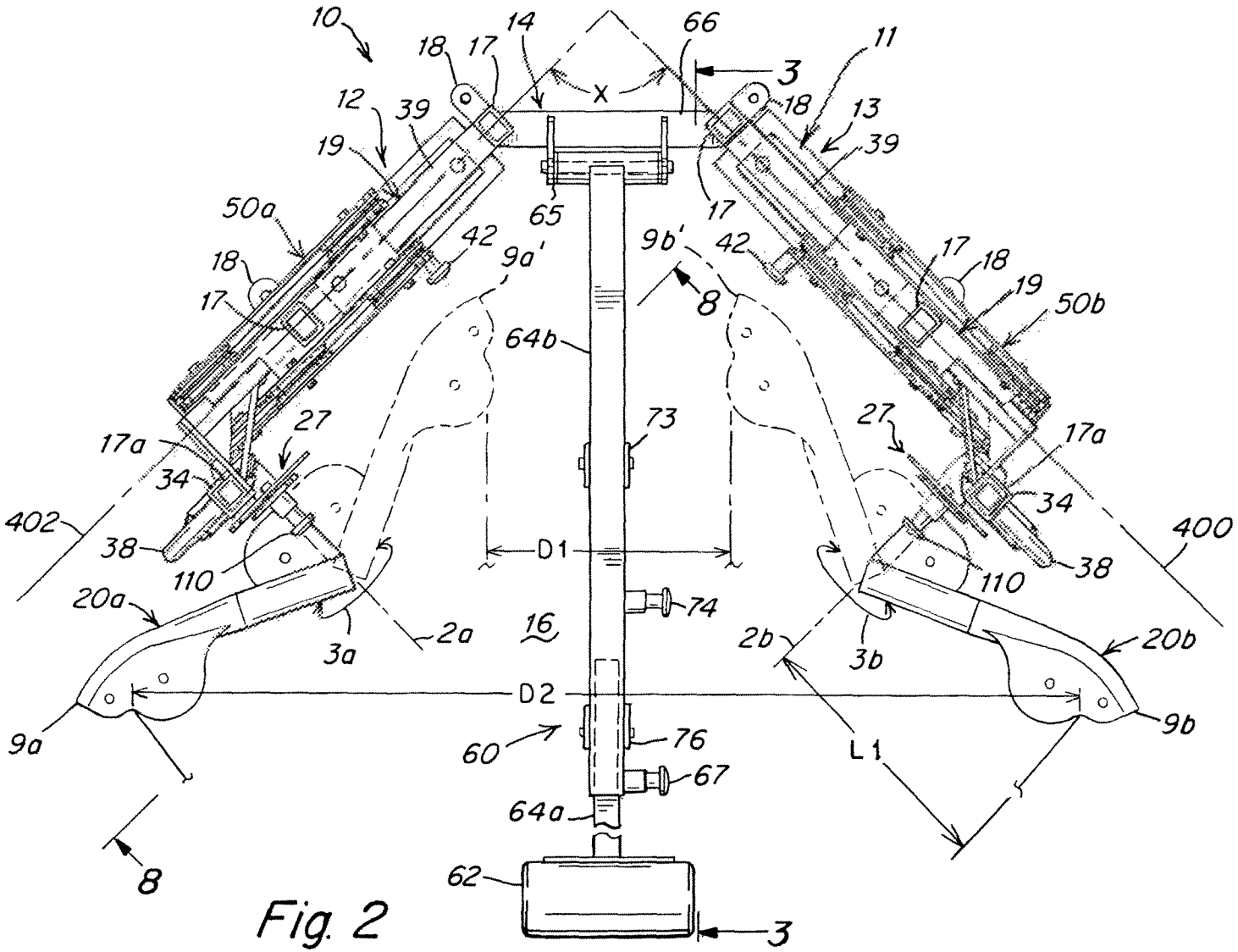
FIG. 2 is a top plan view of the FIG. 1 apparatus showing a pair of rotatable handle positioning arms in two selected rotated positions; in solid lines, the arms are shown outwardly positioned for a pushing exercise, and in dashed lines, the arms are shown inwardly positioned for a pulling exercise; an adjustable partial stabilizer pad is shown extending forwardly and centrally positioned between the left and right arm/handle assemblies.

As shown in FIG. 2, the left and right arm/handle assemblies 8*a*, 8*b* are mounted perpendicularly to frontmost upright frame member 17*a* on the left and right side frames 12, 13, respectively. As a result of their perpendicular mounting to these respective frame elements, the horizontal axes 2 of rotation of the two separate left and right side arm/handle assemblies 8*a*, 8*b* are also disposed at an angle X relative to each other, e.g. of between about 60 and about 120 degrees. As further shown in FIG. 2, the generally horizontally disposed rotational axes 2 are perpendicular to generally vertical planes 400, 402 which are disposed at an angle X to each other, typically between about 60 and about 120 degrees.

The apparatus 10 has a front face 15 which defines a generally triangular area 16 in front thereof where the user is positioned when using the apparatus, so as to have access to the handles 22*a*, 22*b* disposed at the distal ends 9*a*, 9*b* of the distal end portions 21*a*, 21*b* of the arms 20*a*, 20*b*, respectively. Each arm 20*a*, 20*b* also has a rotatable proximal end 23*a*, 23*b*, adjacent and mounted to the front face 15 of frame 11. The arms are thus rotatable in circular arcs 3*a*, 3*b* around axes 2*a*, 2*b* which extend perpendicularly from the left and right side frames 12, 13 respectively. As shown in FIG. 2 the arm/handle assemblies 8 include arm 20 that has an axial length L1.

In this embodiment, each side frame 12, 13 has a generally rectilinear configuration, of a height which is about two to three times greater than its width. For stability and functionality purposes, the frame height will generally be at least as tall as the height of the typical user. Each side frame includes three parallel, spaced-apart upright members 17 connected and rigidified at their upper and lower ends respectively by transverse upper and lower connecting members 39. The lower ends of each upright frame element 17 have a transverse foot 18 which is bolted to the ground 1. Alternatively, some other mechanism may be used to render the frame stationary, e.g. via attachment to one or more of a floor, wall and/or ceiling.

The frontmost upright frame element 17*a* acts as a vertical rail on which a sliding assembly 30, such as a tubular slider 34 (carrying the rotatable arm/handle assembly 8) is slidably movable up and down over rail 17*a* and adjustably positioned via locking pin 36 into one of a plurality of vertically spaced apertures 35. Upper and lower stop elements 37*a*, 37*b* on the front upright 17*a* limit the path of travel of the slider 34. The slider has an attached handle 38 which enables a user to easily move and position slider 34 on the rail 17*a*; slider 34 is then locked into position on rail 17*a* by pin 36, which is spring-biased, and can be manually inserted into any one of the apertures 35 in the upright 17*a*. By pulling back on the head of pin 36, the pin is released and the slider 34 can then be repositioned on the front upright 17*a*. A more detailed description of this arm/handle positioning mechanism is set forth below in a separate subsection.

Each side frame 12, 13 includes its own separate and independent cabling resistance mechanism 40, which in the present embodiment comprises main cable 24, a series of pulleys 51-59, and a weight stack of several individual weight plates 41 slidably movable on two-parallel vertical rails 45. Each weight plate has a horizontal aperture 43 in which a pin 42 is positionable, enabling the user to vary the number of weight plates carried by the weight bearing rod 44, and thus adjust the amount of resistance applied to the handle 22 via the main cable/pulley mechanism. The main cable/pulley assembly is mounted at the top 19 of the frame and will be described in greater detail below.

The rear frame member 14 consists of two transverse (horizontal) beams 66 and 69 which rigidly connect the rearmost frame elements 17 of each of the left and right frames 12, 13, thus forming a truncated corner of the generally triangular shaped apparatus (see FIGS. 1-2). Each of the upper and lower transverse beams 66, 69 carries a pivot member 65, 72, respectively, by which an adjustable partial stabilizer assembly 60 is pivotally connected to the upright stationary frame 11. The partial stabilizer assembly 60 includes a body engaging member, shown here as a contoured pad 62. Pad 62 has a radiused front face adapted to provide a point of contact with the user's torso, so as to partially stabilize the user and aid the user in maintaining an upright posture (balance) while conducting various exercise routines. The pad 62 is only a partial stabilizer in that it provides a baseline of support for the user's torso push against, while the user's torso resists the forces (torque) created by the distance between the handle defined line of motion and the vertical position of the pad on the user's torso (a.k.a. trunk). In this manner, the user can strengthen his/her core body (trunk) musculature while better able to maintain his/her balance in a generally upright position, as opposed to a lying down or seated position. In this embodiment, the front contoured face of the pad has a 6" curvature and the pad is about 10" wide, 9" high, and 4" deep (at the contact radius). The pad can be adjustable in vertically positioned increments of for example about 3", via the mounting mechanism described below. The narrow contact area 262*a* (see FIG. 3) of the pad can be positioned for example against the user's torso (front, back or side) between a mid-scapular level (e.g. as a highest point) and a hip axis level (e.g. as a lowest point).

The partial stabilizer pad 62 is disposed at the front end of a telescoping forward extender 63, which includes a first member 64*a* adjustably (telescopically) positionable within a second member 64*b*, the latter being pivotally connected to a pivot member 65 on upper transverse beam 66. The stabilizer further includes a telescoping height extender 70 (see FIGS. 3-4), which is pivotally connected via a front pivot connector 76 to the forward extender 63. The telescoping height extender 70 includes a first member 71 which is adjustably positionable at its proximal end within a two-piece folding assembly 77. The folding assembly includes a front member 78*a* and a rear member 78*b*; the front member 78*a* is pivotally connected via a middle pivot connector 73 to the rear folding member 78*b*; the rear member 78*b* is pivotally connected to a lower pivot connector 72 on lower beam 69. The telescoping forward extender 63, and telescoping and foldable height extender 70, enable incremental vertical adjustments (e.g. 3" or 4") to be made in the position of the partial stabilizer pad 62, providing in turn selectively variable partial stabilization of the user's torso while performing a given exercise routine. As described in greater detail below, by varying the location of the partial stabilizer assembly with respect to the user's body, the user can increase his/her core body (trunk) strength.

FIG. 2 is a more detailed view of the rotatable arms and adjustable stabilizer of FIG. 1, shown from above. A triangular area 16 is defined in front of the frame 11 by the left and right upright frame members 12, 13 and in front of the rear transverse frame member 14. The partial stabilizer assembly 60 extends forwardly, in a transverse direction to the rear frame member 14, and is centrally disposed between the left and right frame members 12, 13 and left and right rotatable handle/arm assemblies 8*a*, 8*b*. The front extender 63 includes the first extension member 64*a* shown telescopically disposed at its rear end within second extension member 64*b*, and held together by a pin 67 positionable in one of the apertures 68 (see FIGS. 3-4) in rear member 64*b*. The partial stabilizer pad 62 is thus adjustably locked into a fixed forward position in the triangular area 16 defined by the angle X between the left and right frame members 12, 13.

FIG. 2 also shows two alternative rotation positions. In solid lines, the left and right rotatable arms 20*a*, 20*b* are in an outwardly and forwardly disposed (wide angle) position for a pushing exercise. As used herein outwardly is defined transversely with respect to the long cylindrical center line axis of the front extender 63 for mounting of the pad 62; and forwardly is defined transversely with respect to the rear frame element 14. A cable 24 extends from each arm to which a handle (not shown) is attached for grasping by the user. In an alternative position, shown in dashed lines, the rotatable arms 20 have been rotated 180 degrees to a rearwardly and inwardly disposed (narrow angle) for a pulling exercise. A rotatable connector 27 at the end of each arm 20 enables up to 360 degrees of rotational movement of the arm about the axis 2. The rotatable connector 27 is mounted on the frontmost frame member 17, and more specifically on slider 34 which is vertically slideable along the front rail (member 17) for vertical positioning of the arm 20.

Figure 3:
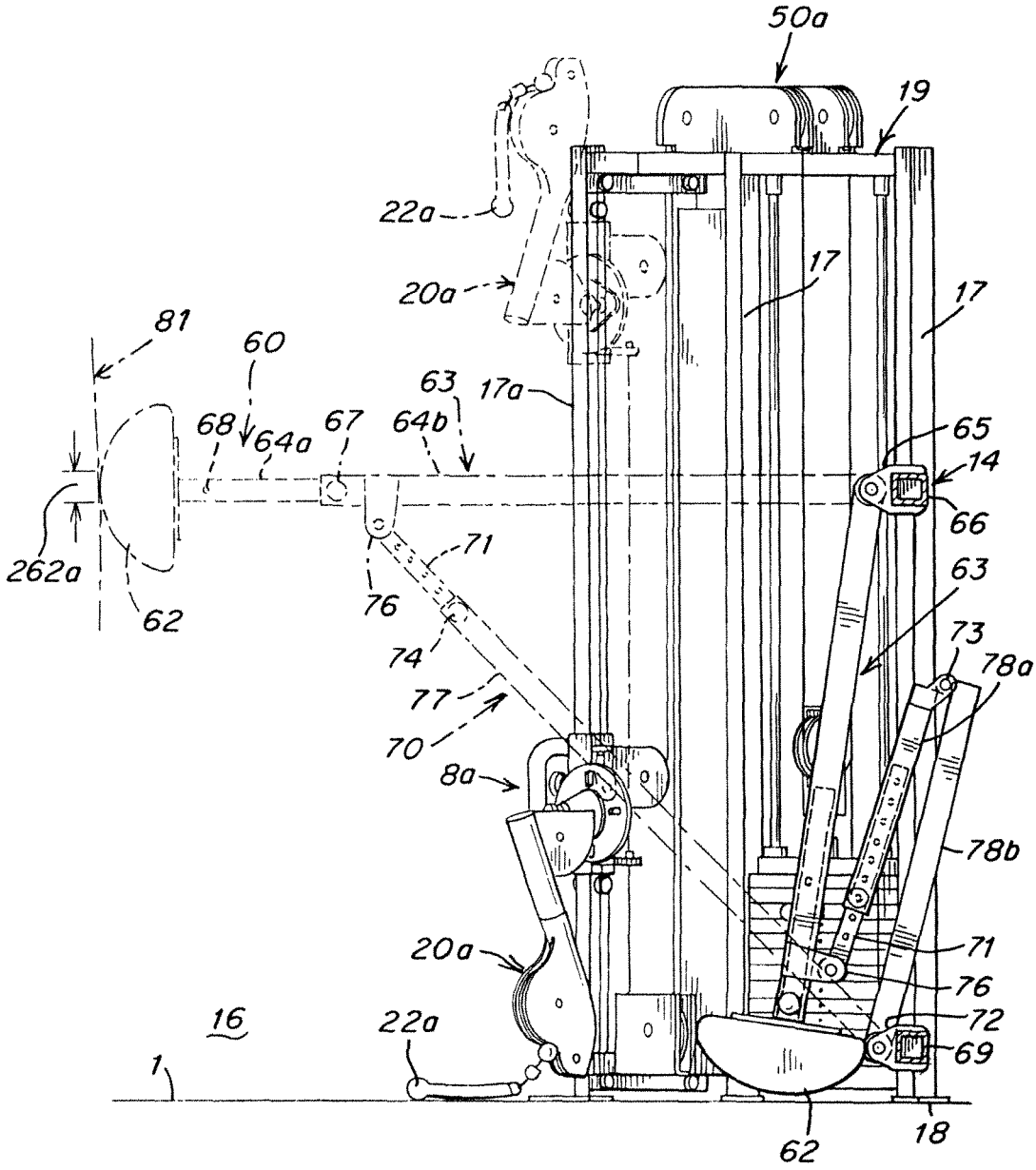
FIG. 3 is a cross-sectional side view of the FIG. 1 apparatus taken along line 3-3 of FIG. 2, showing in solid lines the left side arm rotated downwardly, and moved vertically downwardly to a lower position on the left frame member, and alternatively as shown in dashed lines, rotated upwardly and moved upwardly on the left frame member; the partial stabilizer assembly is shown in solid lines in a folded storage position, and in dashed lines in a forwardly extending substantially horizontal position.

FIG. 3 is a perspective side view of the apparatus of FIG. 1 illustrating the fully extended position of the stabilizer (in dashed lines) and a folded collapsed position (in solid lines). In the collapsed position, the two folding members 78*a*, 78*b* of the height extender are folded together at central pivot member 73. The forward extender 60 and height extender 70 can thus be pushed downwardly and rearwardly into a collapsed position adjacent the rear member 14 of the frame 11. This collapsed position is useful for storage, and for minimizing the footprint of the overall apparatus 10 when not in use. In addition, it enables a user to use the rotatable arms without the stabilizer pad, as shown for example in FIG. 7 and described below.

Figure 7:
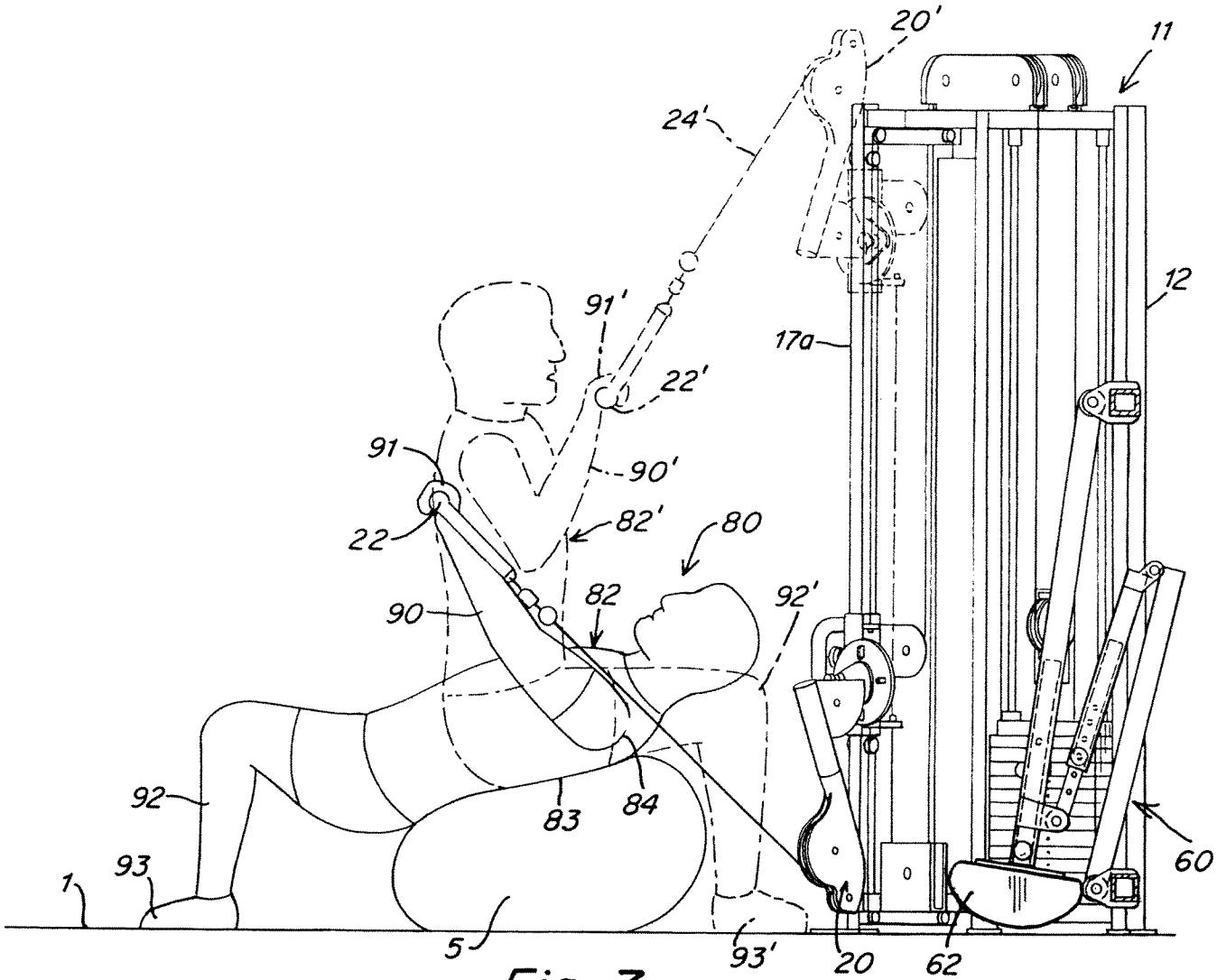
FIG. 7 is a schematic side view of the FIG. 1 apparatus in use, but with the adjustable stabilizer folded away in a collapsed storage position; in solid lines a user is shown lying down with his back on an exercise ball and using a downwardly positioned and outwardly rotated arm for a pushing exercise; in dashed lines, the user is shown seated on the exercise ball and using an upwardly positioned and upwardly rotated arm for a pulling exercise.

In FIG. 3, the rotatable left arm 20*a* is shown in a lowermost position on the front rail 17, and rotated downwardly with the handle 22*a* lying on the ground 1. From this lowermost vertical position (on rail 17) with the arm also rotated downwardly, the user can perform a pushing exercise while lying with his back on an exercise ball 5 resting on the ground 1, as shown in FIG. 7. In an alternative position shown in dashed lines, the arm has been moved vertically (via slider 34) to an uppermost position on the rail 17, and rotated 180 degrees upwardly to an uppermost position. In this position a user can perform a pulling exercise while seated on the exercise ball, as shown in FIG. 7.

Figure 4:
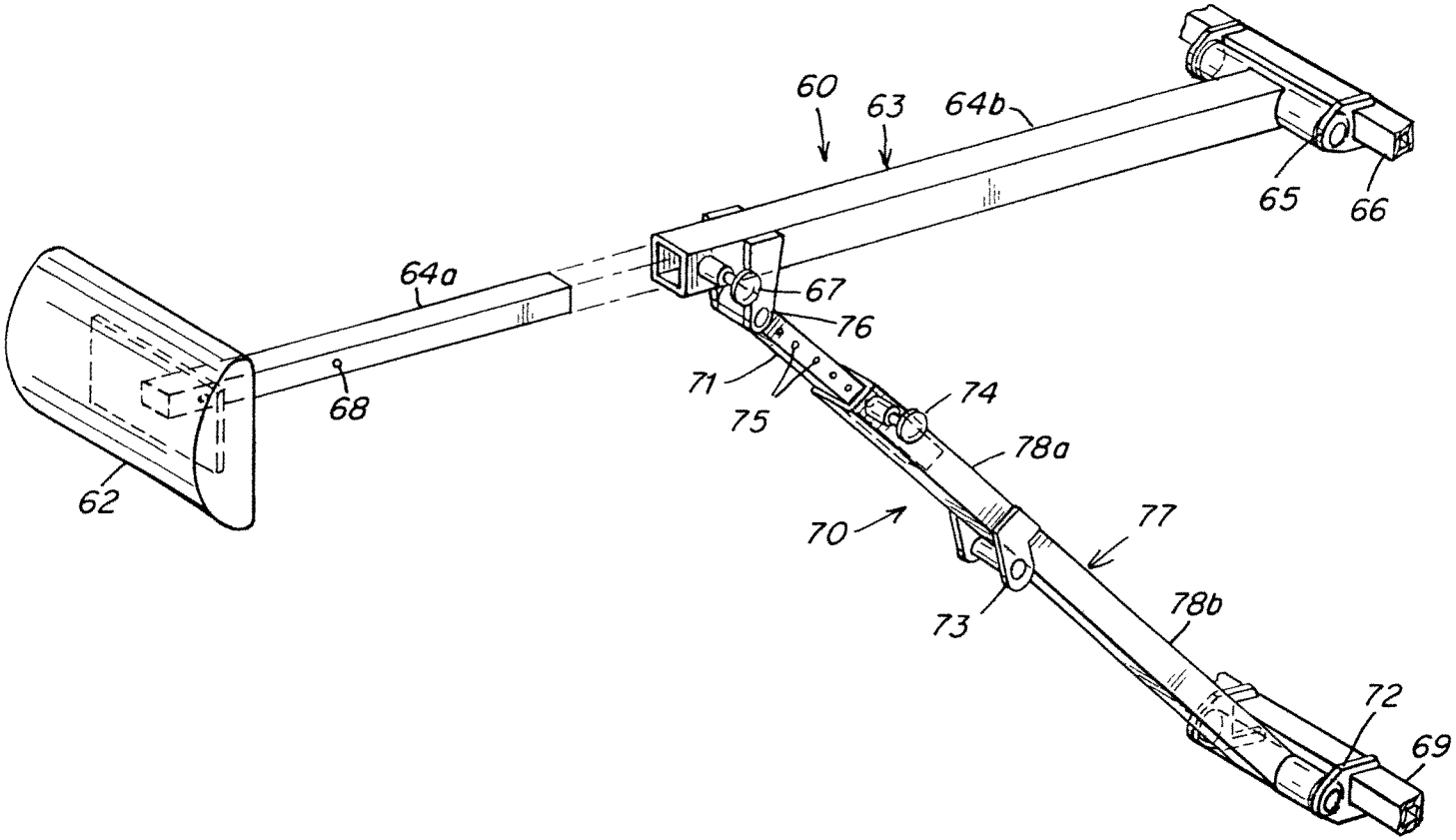
FIG. 4 is an exploded perspective view of the partial stabilizer assembly of the FIG. 1 apparatus.

FIG. 4 is an exploded component view of the partial stabilizer assembly 60 and shows in greater detail the adjustable connecting mechanism between the forward extender 63 and height extender 70. A first extension member 71 of the height extender is pivotally connected at one end by pivot connector 76 to a second extension member 64*b* of the forward extender. The length of the height extender 70 can be adjusted by varying the extent by which the first member 71 extends into the two-piece folding member 77. More specifically, a plurality of apertures 75 are provided in the first member 71, and a pin 74 carried by first folding member 78*a* is used to lock the telescoping member 71 to the first folding member 78*a*. In use, the first and second folding members 78*a*, 78*b* are locked in a linear alignment by the middle connector 73 for greater stability. The proximal end of second folding member 78*b* is pivotally connected to the lower beam 69 on frame 11, via the pivotal connector 72. Similarly the forward extender 63 is pivotally connected to the upper beam 66 of frame 11 via the connector 65, at the proximal end of forward extender 64*b*. Thus, the combination of telescoping extensions of the forward extender 63 and height extender 70, coupled with the pivotal connections 65, 72 at the proximal end of each extender for rotational movement about the upper and lower transverse beams 66 and 69 on frame 11, together provide a range of adjustability for positioning of the pad 62 for a multiplicity of exercise routines.

Method of Use

Figure 5:
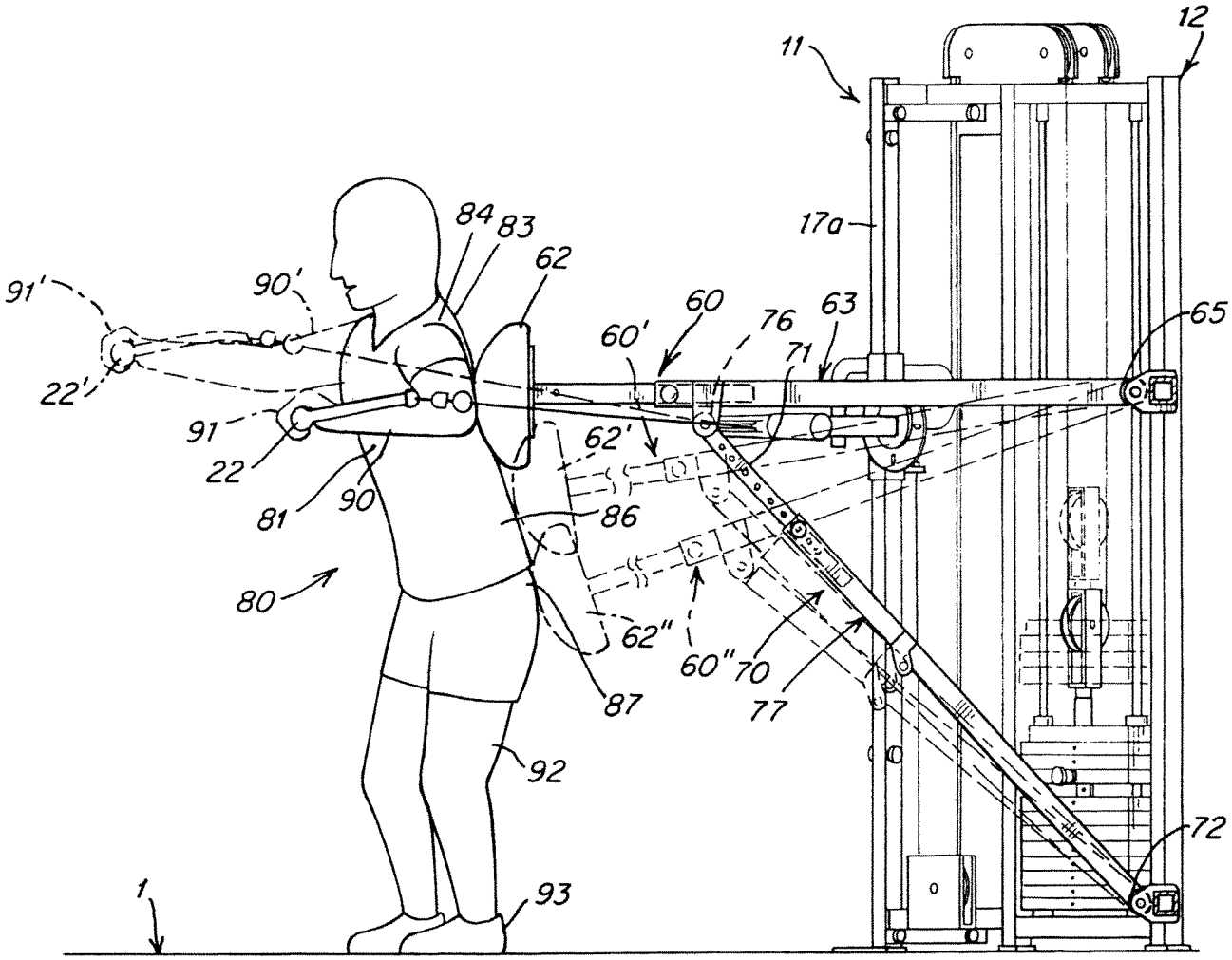
FIG. 5 is a schematic side view of the FIG. 1 apparatus in use, showing a user's torso (backside) partially stabilized in three alternative positions by the adjustable stabilizer, while performing a pushing exercise with the handle positioning arms rotated outwardly.

FIG. 5 illustrates one method embodiment for conducting a series of core body strengthening exercises with the apparatus of FIG. 1. A user 80 is in an upright (here standing) position in front of the frame 11, with his back 83 towards the front face 15 of the frame. With one or both of his arms 90, 90', the user will perform one or more pushing movements, while his back is pushing against and partially stabilized by the stabilizer assembly 60. In a first method step, the stabilizer assembly is positioned in an uppermost, substantially horizontal position with the front extender 63 horizontally disposed, parallel to the ground 1, and transverse to the upright frame members 17. The height extender 70 is substantially fully extended with the two folding members 78*a*, 78*b* and telescoping distal member 71 aligned in a straight line and locked position. The frontmost contour of stabilizer pad 62 is positioned mid-scapula against the upper back of the user. The user grasps each of the handles 22, which have been rotated to a fully outwardly (wide angle) starting position for this pushing exercise. The user's arms 90, 90' can be extended at substantially shoulder level, one at a time or together, while the user's torso is partially stabilized by the pad 62. In this first step, the contact point of stabilizer pad 62 is offset a first amount from the line of movement of the handle(s), as the user pushes the handle(s) forwardly, starting at about chest 85 level, and ending at about shoulder 84 level. The line of movement is defined by the path of the distal end of the resistance cable 24, extending from arm 20. The relatively small offset angle between the contact point of the stabilizer pad and the line of movement of the user, as established by the path of the handle(s), creates a relatively small amount of torque for the user's torso to overcome, and thus strengthen the user's core muscular strength. In a succession of next steps, described below, the amount of offset between the line of movement and the stabilizer pad contact point increases, thus increasing the amount of torque that the user must overcome to perform the exercise while maintaining an upright stature.

In a second step, the stabilizer pad 62' has been moved downwardly on the user's torso, and the contact point (baseline of support to push against) is now positioned just above the user's waist 86. When the user now performs the same pushing exercise, there will be a relatively greater amount of offset between the line of movement and stabilizer contact position, thus increasing the torque which the user must overcome to perform the exercise and maintain an upright stature.

In a third position, the stabilizer pad 62" has been moved even lower to a third position in contact with the user's rear torso at hip 87 level, below the waist. Now, there is an even greater amount of torque which the user must overcome to perform the pushing exercise and remain upright.

Figure 6:
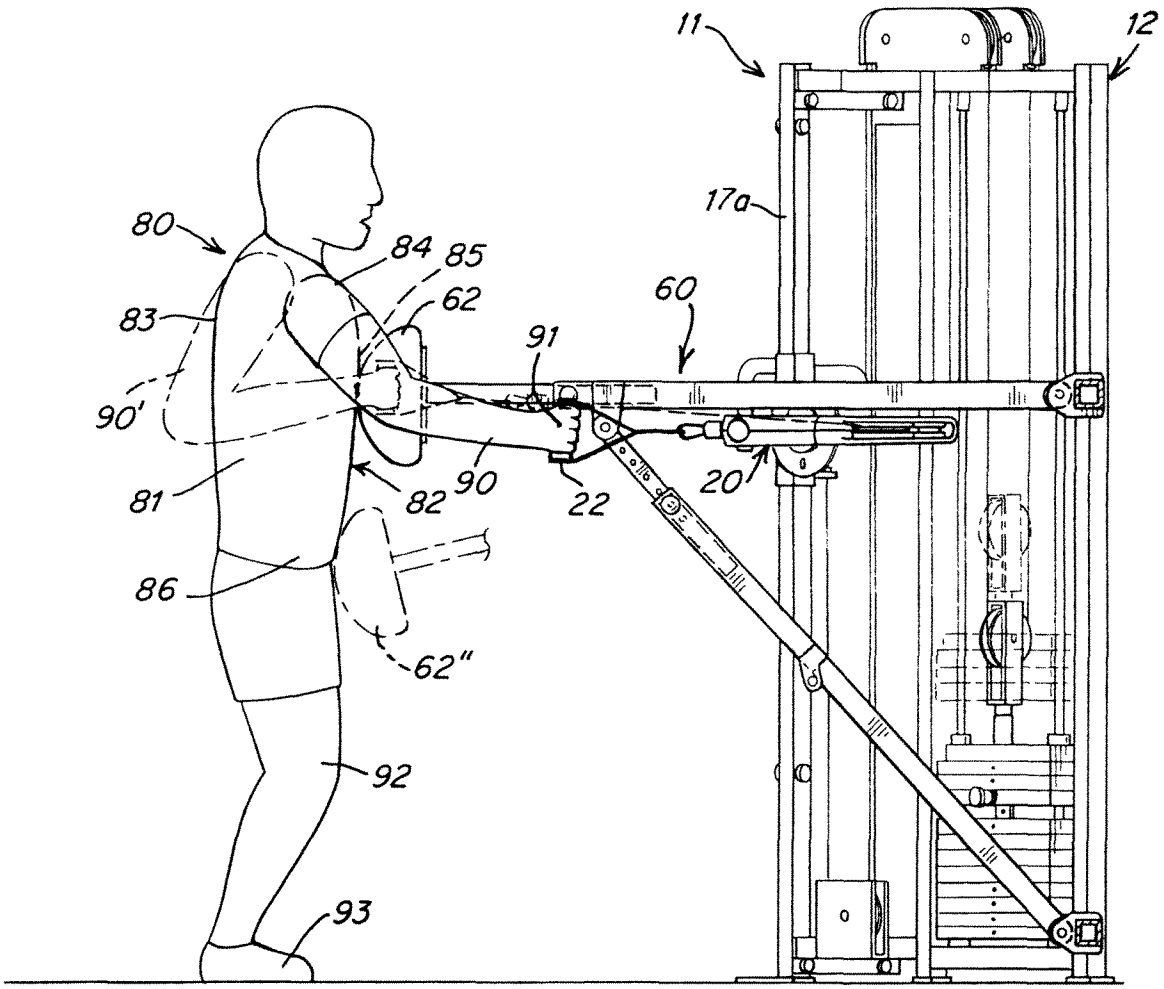
FIG. 6 is a schematic side view similar to FIG. 5 but showing a user's torso (frontside) partially stabilized in two alternative positions by the adjustable stabilizer, while performing a pulling exercise with the handle positioning arms rotated inwardly.

FIG. 6 illustrates, similar to FIG. 5, another method embodiment for use of the apparatus of FIG. 1, however in this example the user is conducting a pulling exercise. Although only two positions of the stabilizer pad are shown in FIG. 6 it is understood that the user can adjust the position of the contact point of the stabilizer pad over a much larger number of positions to provide increasing amounts of torque which must be overcome to perform the exercise and maintain an upright stature.

As shown in solid lines in FIG. 6, the stabilizer pad 62 is again disposed in a fully forward and central position, with the front extender 63 extending vertically (parallel to the ground). The rotatable arm 20 has been rotated 180° and is now directed rearwardly and inwardly, so as to provide a relatively narrow starting angle (e.g. distance D1 in FIG. 2) between the two rotating arms. This facilitates a pulling exercise, where the user's hands would start the exercise at a relatively inward position, and the user's hands would then diverge outwardly while pulling back on the handles. The central contour on the front face of the pad 62 is positioned on a central portion of the user's chest. The user begins the pulling motion with his arm 90 extended forwardly, and in the course of pulling the handle rearwardly, the handle traverses a path of movement in a rearwardly and outwardly direction. In this initial position there may be little if any vertical offset between the pad contact position and the line of movement, thus substantially isolating the chest pull movement and not creating any significant torque to overcome by the user's torso. However, the difference between the path of movement and the point of stabilization (location of pad 62) on the front of user's torso can be successively increased to increase the torque which the user must overcome to perform the exercise and remain upright, and thus increasingly enhance his core body strength. FIG. 6 shows a lowermost contact position of pad 62" at the user's hip 87, where a large amount of torque would be generated. It is understood by the skilled person that the user's weight, height, and length leg, etc. will all effect the amount of force (torque) which the user's torso must overcome to maintain his/her balance.

FIG. 7 illustrates a further alternative method for utilizing the apparatus of FIG. 1. In this embodiment, the partial stabilizer pad 62 is not required, and instead the user attempts to stabilize his/her body against an exercise ball 5 which is placed in area 16 in front of the machine 10. In one method embodiment, shown in solid lines, the user 80 is lying with his back 83 on the exercise ball 5 and is performing a pushing exercise with his arms 40, pushing upwardly and away from his chest 85. The rotatable handles 22 are positioned outwardly and downwardly to provide a relatively wide angle at the beginning of the movement, wherein the user's arms would typically move inwardly and upwardly while performing the pulling movement.

In an alternative method embodiment, the user 90' in FIG. 7 is shown in dashed lines, seated on the exercise ball 5 in front of the machine. Here, he is performing a pulling exercise with his arms 90', and is facing the machine. The arms 20' are rotated fully upwardly and inwardly, wherein the user begins a pulling motion with his arms 90' extended forwardly and upwardly to grasp the handles 22'. The user then pulls on the handles downwardly and outwardly to define the line of motion of cable 24; and completes the movement, by bending his elbows until the handles are positionable just in front of his chest 85'. In this embodiment, the user can move the exercise ball forwardly or backwardly with respect to the front face of the machine, to increase or decrease respectively the amount of torque applied to the user's torso while performing the exercise. In this way, he can also gradually increase the difficulty of the pulling motion and the resistance required to maintain a seated posture on the exercise ball.

The partial stabilizer pad can be used in other exercise apparatus and the invention is not limited to use with the disclosed framework. Similarly the partial stabilizer pad can be used for other exercises in other method embodiments.

Other embodiments and variations will be apparent to the skilled person and are included in the method and apparatus of the present invention. For example, a dual handle machine is shown; in another embodiment, only a single handle/cable/weight resistance mechanism may be provided with an adjustable partial stabilizer pad. In the present embodiment, each of the two handle/arm assemblies is independent and has an independent cabling resistance mechanism; alternatively, a single or partially combined cabling and/or weight resistance mechanism may be provided for both handle/arm assemblies. Further, while the user is shown standing upright in one embodiment which using the partial stabilizer, he may alternatively, as shown in FIG. 7, also use the apparatus without the partial stabilizer while sitting or lying down on either an exercise ball, bench or seat. Also, while the user is shown here performing arm exercises and gripping a handle at the end of the resistance cabling, in other embodiments the user can perform leg exercises wherein the user's leg, ankle or foot is engaged by a strap or other attachment member provided at the end of the resistance cable. Also, as used herein, handle is not limited to any specific form of handle, but includes any grip member by which the user may grip the end of the resistance cable. Thus, other embodiments of the method and apparatus are intended to be included in the scope of the present invention.

Cabling Assembly

A more detailed description of the previously identified cable and pulley assembly will now be provided. The cable and pulley assembly provides the cable connected to the handle, which cable defines the line of motion when the user pulls/pushes on the handle. As previously described, this line of motion can be offset, in varying amounts, from the location at which the user's torso is stabilized by the stabilizer pad, in order to increase the torque which the user must withstand to perform a selected exercise and remain stationary (generally in an upright standing position). The cable/pulley assembly connects the handle with the weight resistance mechanism, e.g. the weight stack, which may include a plurality of individual weight plates and means enabling the user to select one or more plates for varying the weight resistance encountered in a given exercise. According to one embodiment of the present invention, the cable and pulley assembly attached to the weight resistance mechanism provides one flexible cable (for an associated handle) which cable is routed around a series of pulleys in a loop such that the cable loop length remains constant, and the handle's starting distance from the rotating arm remains constant, in all vertically adjustable positions of the rotating arm. A second cable/pulley assembly functions as a counterbalance to offset the weight of the arm.

Figure 8:
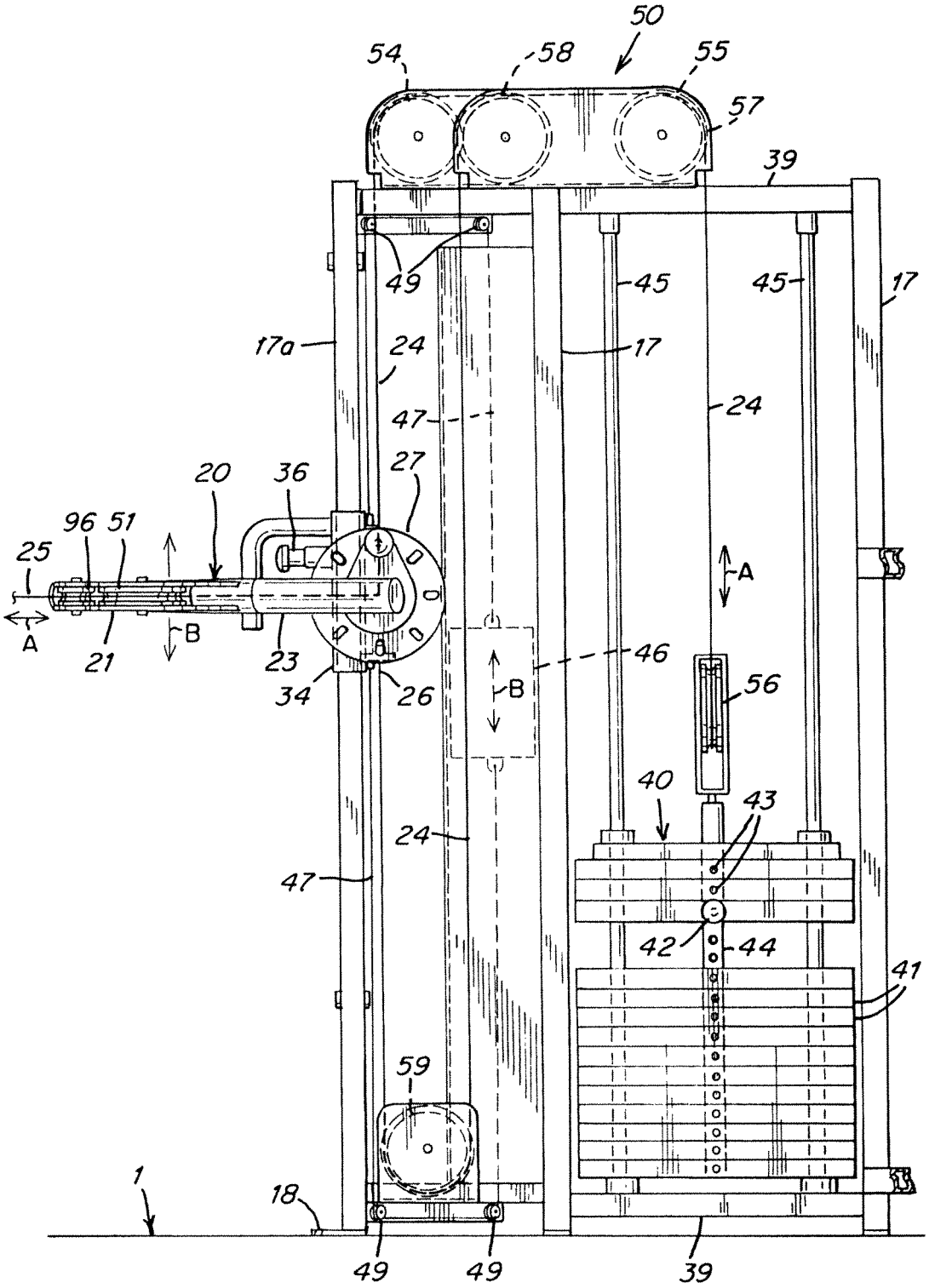
FIG. 8 is a front elevational view of the weight stack and associated cable/pulley assembly of the apparatus of FIG. 1, as seen along line 8-8 of FIG. 2.
Figure 9:
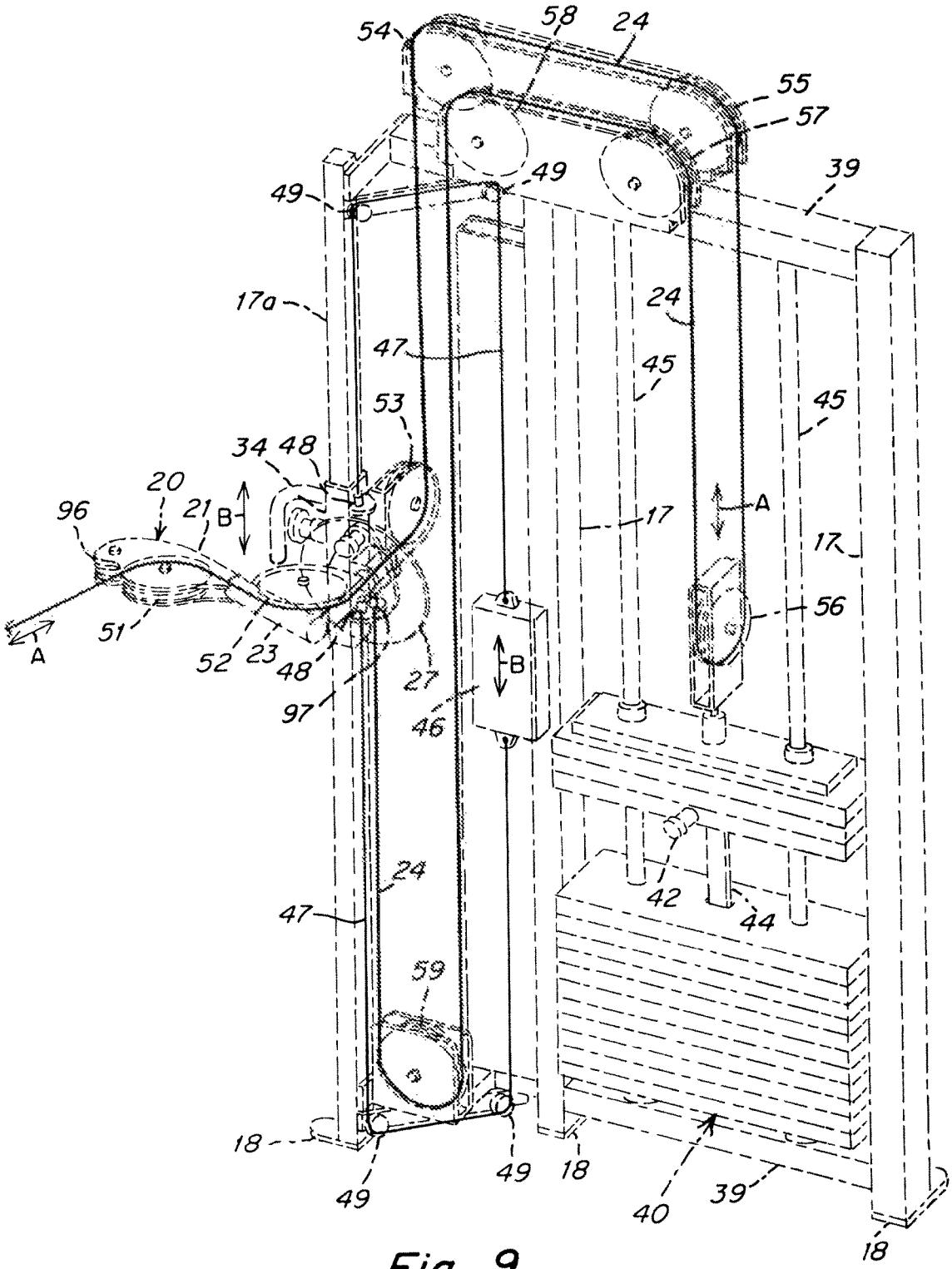
FIG. 9 is a schematic perspective view of the weight stack of FIG. 8 in use.
Figure 10:
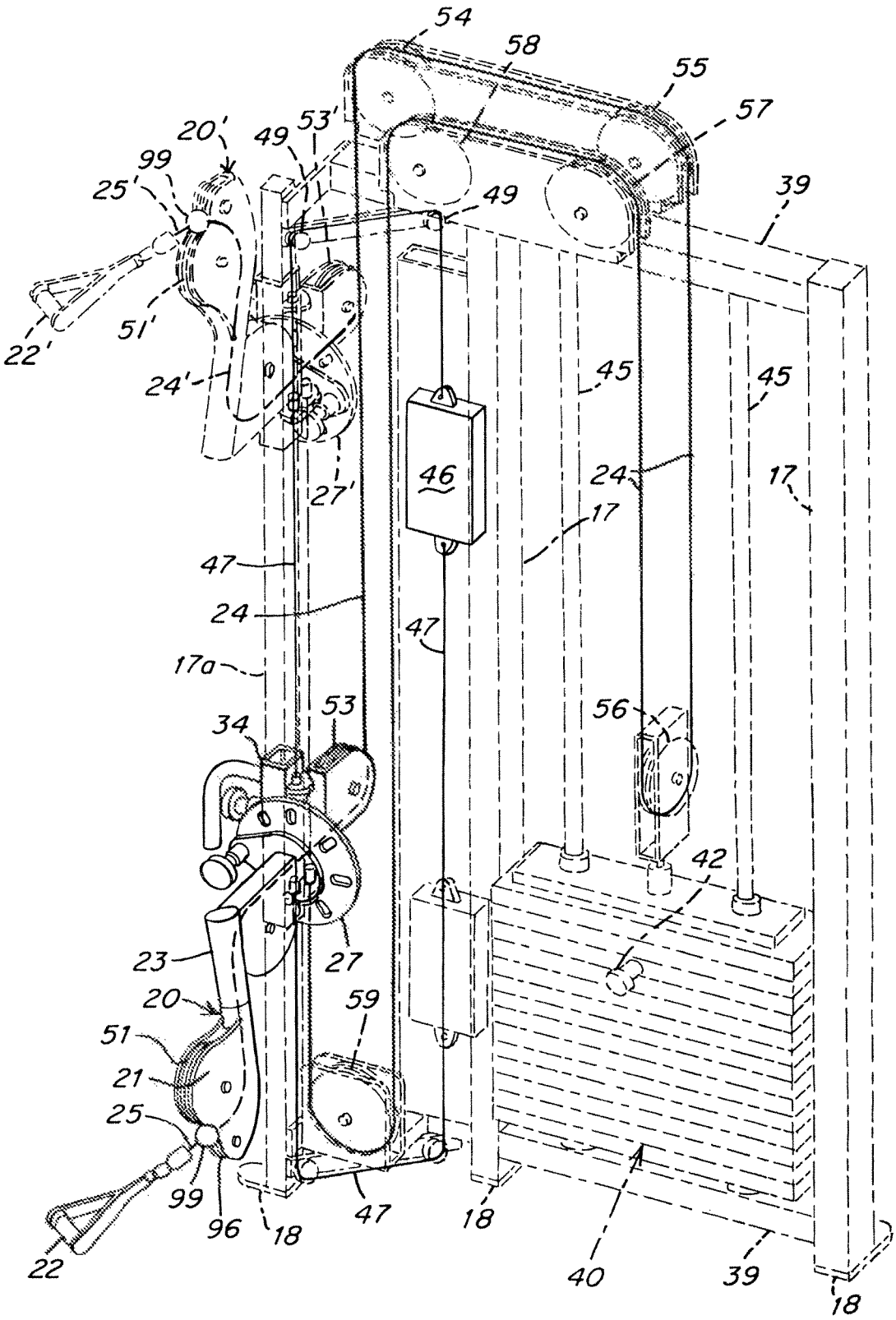
FIG. 10 is a schematic perspective view showing the arm counterbalance cable/pulley assembly of FIG. 8 in use.

FIGS. 8-9 show the main cable/pulley assembly 50 of the apparatus of FIG. 1 in which a single flexible cable 24 extends from the handle 22 (not shown) through rotating arm 20 and is attached via pulleys 53-59 to the weight stack 40 and ultimately to the frame 11. The second cable/pulley assembly 46-49, which functions as a counterbalance to the weight of the arm 20, is also shown. FIGS. 8-9 show the handle/arm disposed centrally along the height of the rail 17, while FIG. 10 shows alternative positions of the arm 20 at lowermost (in solid lines) and uppermost (in dashed lines) positions on the rail.

Starting on the left side of FIG. 8, the distal end 25 of main cable 24 is shown extending from rotating arm 20. The rotating arm is disposed at a central vertical position, as determined by the position of slider 34 on the front upright frame member 17. The arm is shown in an forwardly rotated position (with respect to the rear frame element 14 of the frame 11). The cable 24 is routed through two pulleys 51-52 in the arm 20 and passes through the selected rotation position defined by rotation axis 2. The cable 24 is further routed around a series of pulleys 53-59 which are all mounted such that when the handle 22 is pulled (or pushed) outwardly from the distal end of arm 20, the cable 24 pulls upwardly on the weight stack 40.

Figure 11:
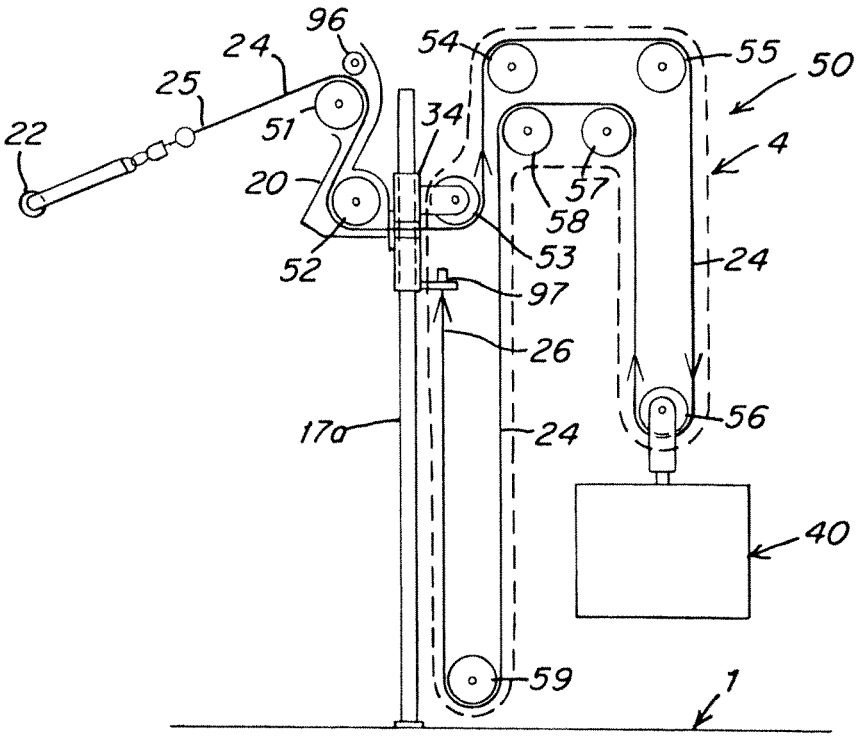
FIGS. 11-12 are simplified schematic views of the main cable assembly in use with the rotating arm at two different vertical heights, as shown in FIG. 10.
Figure 12:
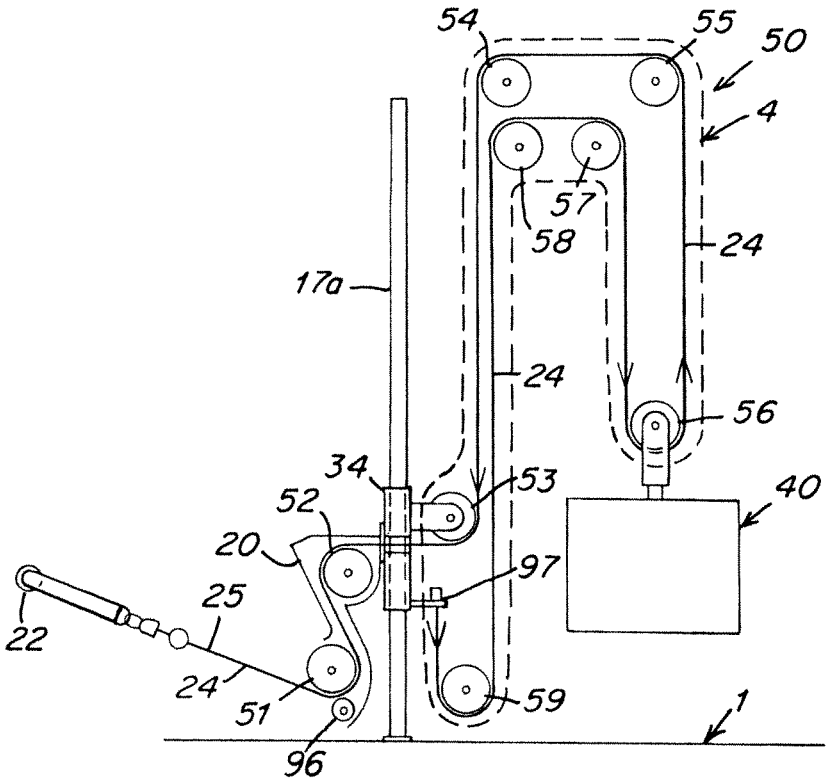

FIGS. 11-12 are simplified perspective views showing the single main cable 24 extending from the handle 22 through the arm 20 (which includes pulleys 51-52), being further routed through pulleys 53-59 (for attachment to the weight stack 40) and connected at an opposing proximal end 26 to the stationary upright frame member 17. As is evident from FIGS. 11-12, the loop length, outlined by dashed line 4, of the cable 24 around pulleys 53-59 remains constant, so that the (starting) handle distance from the rotating arm is constant, in all vertical and rotational positions of the handle 22 and arm 20.

Returning to FIG. 8, as handle 22 is pulled outwardly from arm 20 (see arrow A), the cable 24 pulls upwardly on floating pulley 56 (see arrow A'). Pulley 56 is connected to the weight stack 40 and, as a result, the selected plates of weight stack 40 are pulled upwardly along with pulley 56 via the weight bearing rod 54, thus creating an opposing force to the user's pulling (or pushing) on the handle 22. As previously described, in the present embodiment there are two separate (independent) weight resistance mechanisms and handle/pulley assemblies, one for each of the two handles for engagement by the user's left and right hands/arms. The user may utilize a single handle during a given time period, or simultaneously pull/push outwardly on both handles in a given time period. As shown, each of the rotating pulleys 54, 55, 57, 58 and 59 (for main cable 24) are connected or anchored to a stationary component on the frame 11. Pulley 56 is floating, enabling upward pulling of the weight stack 40. Three of the pulleys, 51, 52 and 53, are effectively mounted on slider 34 which is vertically movable on upright frame member 17, for adjusting the vertical position of the arm 20 and associated handle 22. The first two pulleys 51, 52 guide the cable through arm 20, while the third pulley is mounted directly on the slider 34. However, once the user selects and locks the slider into a fixed vertical position on rail 17, these three pulleys are also connected to a stationary component on the frame 11.

The distal end 25 of main cable 24 is provided with a stop 99, as shown in FIG. 10, which prevents the cable from being retracted into the arm 20. A follower pulley 96 is provided in arm 20, across from rotating pulley 51, which cooperates with pulley 51 to provide an interference mechanism for stop 99, thus limiting the backward movement of the distal end 25 of the cable (to which handle 22 is attached).

The weight resistance mechanism 40 shown in the embodiment of the figures comprises a stack of incremental weights, any selective number of which can be interconnected to the main cable/pulley assembly before beginning an exercise, e.g. by inserting a pin 42 through a lateral aperture 43 which is provided in each of the incremental weights 41 in the stack and continuing through a complimentary aligned aperture provided in the weight-bearing rod 44 which is connected to pulley 56. Other weight resistance mechanisms can be provided in alternative embodiments, such as free weights, high tension springs, high tension stretch or compression members, a forced resistance rotating mechanism, a container fillable with a selective amount of fluid, or the like.

To counterbalance the weight of the handle/arm assembly 8, a separate counterbalance cable/pulley assembly is provided which includes counterbalance weight 46 attached to counterbalance cable 47, the cable 47 extending between opposing anchors 48, 48 each attached to frame element 17. Cable 47 is routed around four pulleys 49, each mounted on the frame 11, which pulleys define a generally rectilinear route for counterbalance cable 47. The counterbalance weight 46 is moveable vertically as shown by arrow B.

Other embodiments and variations will be apparent to the skilled person and are intended to be included in the cabling assemblies of the present invention.

Rotatable and Vertically Adjustable Arm Assembly

A more detailed description of the previously identified arm assembly will now be provided.

The arm 20 provided at the distal end of the main cable 24 has multiple freedoms of movement: it is vertically adjustable by reason of being mounted on a sliding assembly 30 (e.g. slider 34) which is vertically movable on the frame 11; it has a rotational plane of movement by reason of being rotatably mounted (e.g. on a connector 27) to the sliding assembly; and further the arm itself is a multi-component part (e.g. proximal and distal arm portions 21, 23) wherein one end of the arm is rotatable with respect to the other end of the arm by reason of a swivel mechanism between the two end portions of the arm. These multiple freedoms of movement allow for a plurality of ergonomically correct positions of the gripping member (e.g. handle) provided at the end of the cable for a plurality of different exercises performed by the user in a plurality of different positions in the area in front of the exercise machine 10.

The multiple freedoms of movement of the arm reduce the "footprint" (occupied floor space) of the exercise machine in use (i.e. combined space occupied by the machine and the user), thereby enabling the user to perform a variety of different exercises while confined to a relatively limited space in front of the machine. This is particularly important in the context of performing exercises with the adjustable partial stabilizer pad 62 which extends forwardly from the frame. There is a limit to how far the partial stabilizer pad can extend forwardly from the machine, and still provide a pad which is easily adjustable, collapsible, and can be economically manufactured. For example, a stabilizer pad that extended way beyond the depth (perpendicular to rear frame number 14) of the triangular frame 11 would be unwieldy, unstable, and/or create such a large moment (torque) on the frame as to excessively pull on the frame, possibly loosening its connection to the floor, and/or causing the frame to be unstable. In contrast, while prior art exercise machines (without a partial stabilizer pad) may enable a user to perform a variety of exercises, for many of these exercises the user is positioned so far away from the frame of the machine itself, it would be impractical or impossible to add a stabilizer pad to such an apparatus. In the present embodiments of the invention, the combination of the adjustable partial stabilizer pad, together with the arms having multiple freedoms of movement, enable the user to be confined, within a relatively small area in front of the machine (e.g. about twice the depth of the machine itself) and still allow a user to perform all of the desired exercises.

In addition, the counterbalance weight and cabling system 46-49 attached to the arm 20, compensates for the weight of the arm itself and enables the user to easily reposition the arm. These and other features of the invention are described in detail below with respect to the embodiment of FIG. 1.

Figure 13:
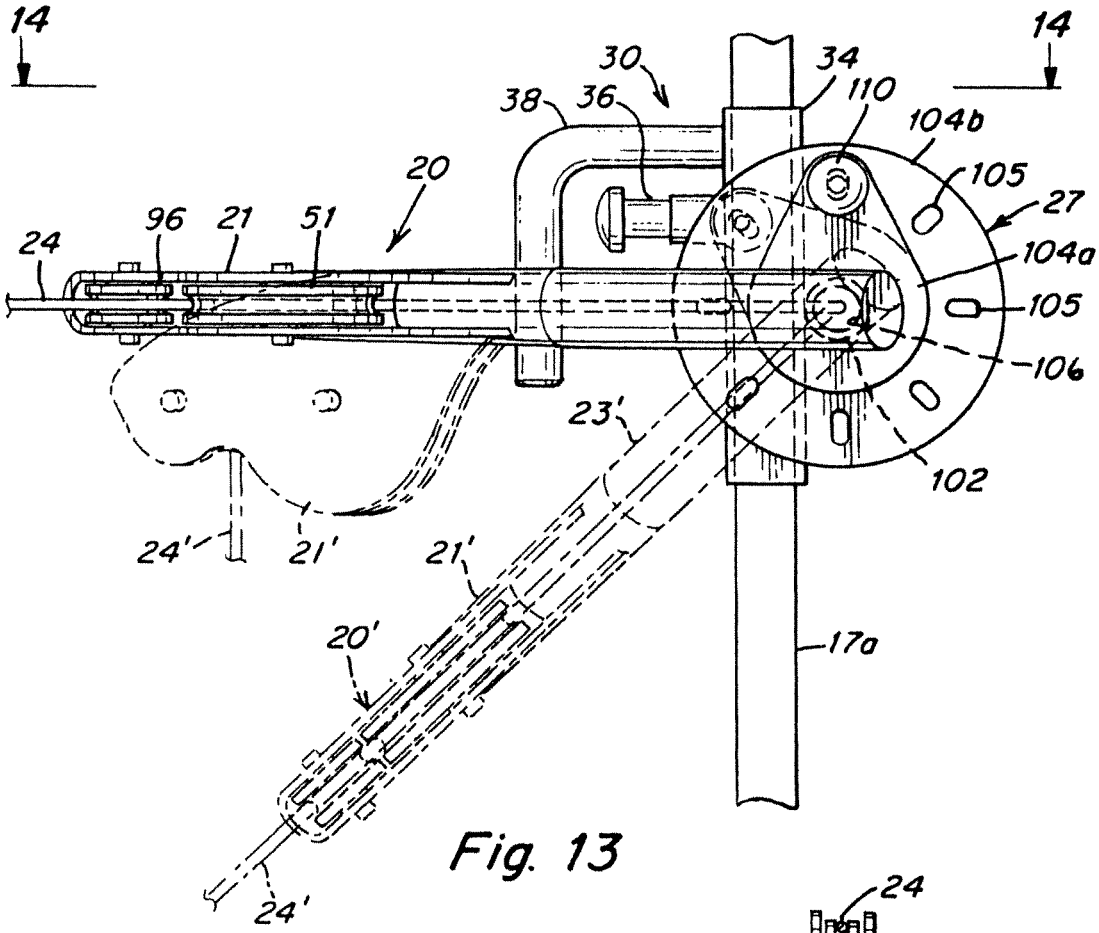
FIG. 13 is a partial front elevational view of the vertically adjustable and rotatable arm assembly of the apparatus of FIG. 1, showing two rotation positions of the arm; in solid lines the arm is positioned fully outwardly in a horizontal position, parallel to the ground, and in dashed lines the arm has been rotated about 45° downwardly.
Figure 14:
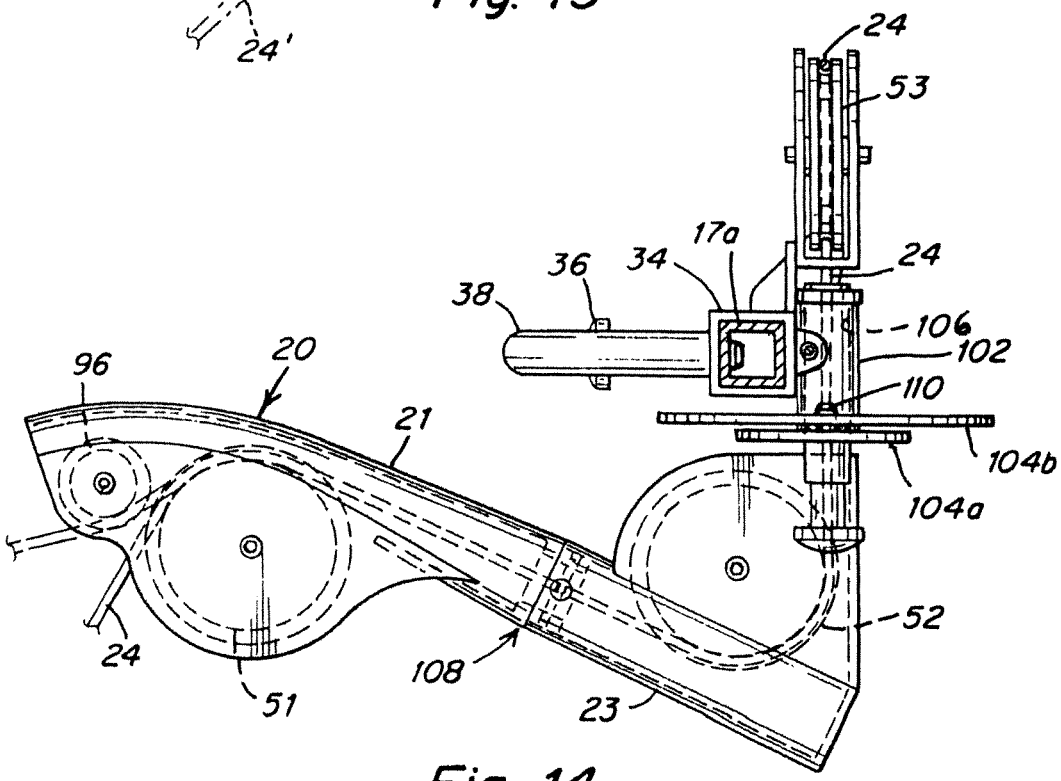
FIG. 14 is a top elevational view of the arm assembly as seen along line 14-14 of FIG. 13.

FIGS. 13-14 show one of the two (left and right) sliding assemblies 30 positioned on a front rail (frame member) 17 of the exercise machine 10. The sliding assembly includes a sliding tube 34, having arm 20 attached thereto via the connector 27, and having a handle 38 which the user can grasp to move the slider 34 up and down on rail 17. A retractable locking pin 36 on slider 34 is positionable in a selected one of the plurality of apertures 35 on rail 17, for locking the sliding assembly 30 in position during an exercise.

The connector 27 mounted on slider 34 has a cylindrical member 102 with a central bore 103 through which a portion of main cable 24 extends between pulley 52 (on arm 20) and pulley 53 (mounted on slider 34). A cylindrical projection 106 extending from proximal end portion 23 of arm 20, is positioned in the bore 103 of member 102 of connector 27, and has a central bore 107 through which the cable portion extends. In this manner, the main cable 24 is allowed to travel with the sliding assembly 30 on rail 17 of the frame, enabling the vertical adjustability of the arm 20 on the frame.

The connector 27 has two parallel spaced apart discs, **104*a* and 104*b*. The front disc 104*a* carries the arm 20 and pin 110. The arm 20 is welded to an inner tube 103 which extends through an outer tube 102, the outer tube being welded to slider 34. The inner tube 103 is rotatably movable within the outer tube 102** and held in lateral position by a washer and adjustment screw.

The connector 27 further includes a rear face plate **104*b* transverse to cylindrical member 102 and having a plurality of apertures 105 to enable a retractable locking pin 110 to rotatably position and lock the proximal end of the arm 20 in one of the apertures 105. The apertures 105 are positioned around the circumference of the circular plate 104, and define a plurality of fixed rotational positions of arm 20 on the slider 34**.

The arm 20 includes proximal end portion 23, rotatably mounted on connector 27, and an opposing distal end portion 21 adjacent the handle 22. The distal 21 and proximal 23 portions of the arm are rotatable, one with respect to the other, by means of swivel mechanism, adjustably rotatable mechanism or other rotating bearing mechanism 108 which connects the two portions. Each of the arm portions 21, 23 has a hollow interior containing the pulleys 51 and 52 around which the main cable 24 is routed through the arm; the follower pulley 96 adjacent main pulley 51, is also located at the distal end 9 of the arm 20.

Figure 15:
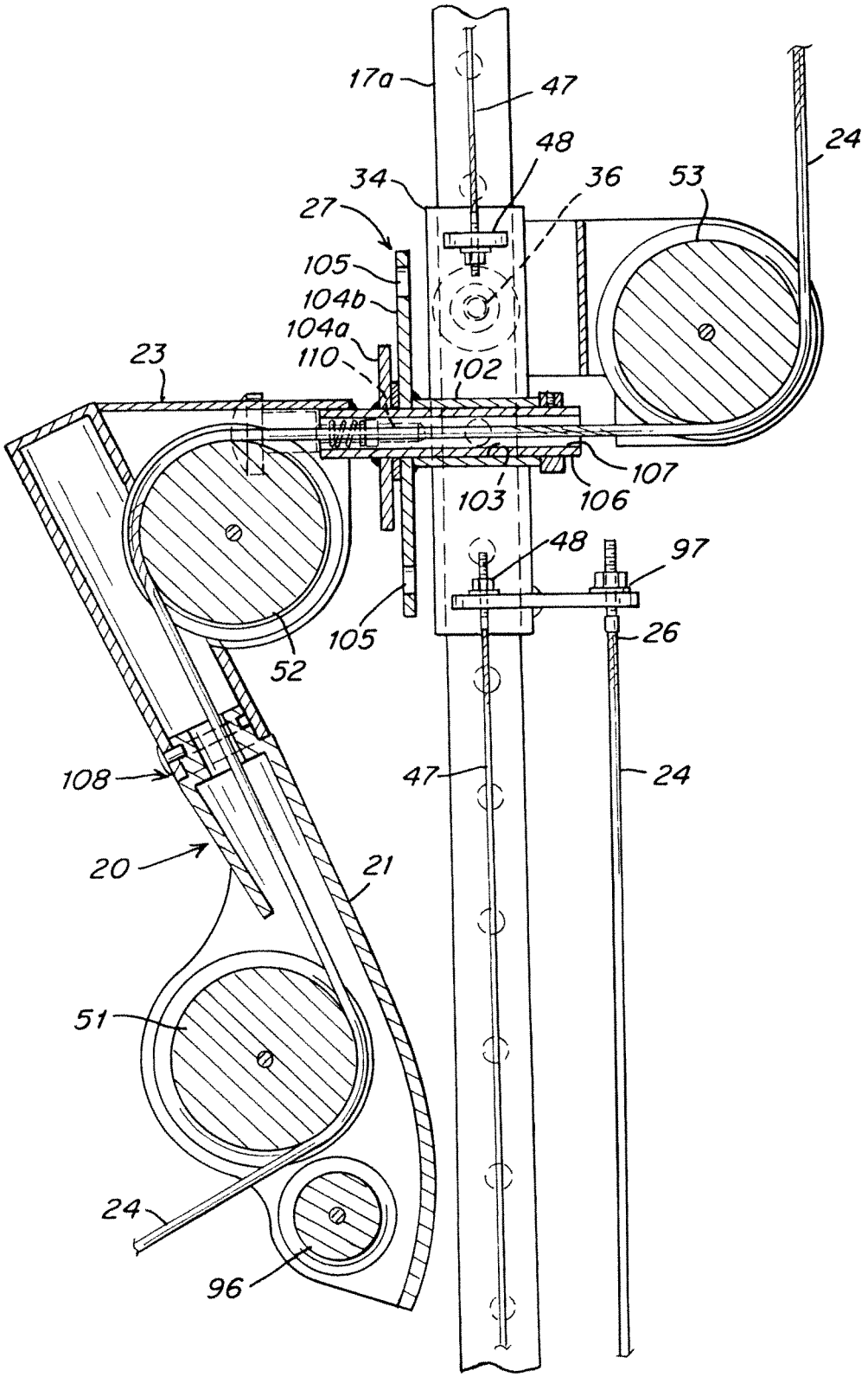
FIG. 15 is a partial side elevational view of the arm assembly rotated fully downwardly in a vertical position, and illustrating the main cable and counterbalance cable connections as well as the arm components and its attachment to the vertically adjustable sliding assembly on the frame.

The weight of the arm 20 is compensated for by a counterbalance cable and pulley mechanism which includes secondary cable 47, shown in FIG. 15 extending along the rail 17, and connected at first and second ends to a mounting mechanism 48 at opposite ends of the slider 34. The main cable 24 has its proximal end also mounted to the slider 34, at main cable anchor 97.

FIG. 13 shows two alternative rotation positions of the arm 20. In solid lines, the arm is rotated fully forwardly and is horizontally disposed parallel to the ground; this would be the arm position in use (while the user pulls on the handle). FIG. 13 also shows, for this position, in dashed lines the distal end portion 21 of arm 20 rotated 90 degrees downwardly with respect to proximal end portion 23, so that cable 24' now extends vertically downwardly traverse to the ground; this would be the arm position at rest (before the user pulls on the handle). FIG. 13 also shows, in dashed lines, a second rotation position with the arm 20 rotated 45 degrees downwardly from the first position (i.e. locked into an adjacent aperture 105 in face plate 104 of connector 27 which is located counterclockwise downwardly from the aperture 105 of the first position). The cable 24' now extends at a 45° angle down toward the ground. FIG. 14 shows a top view of the arm assembly of FIG. 13, taken along line 14-14 of FIG. 13.

Alternative Embodiment

FIGS. 16-24 illustrate an alternative embodiment of a progressive resistance training apparatus according to another embodiment of the invention. The apparatus is similar in many respects to the apparatus of FIG. 1, and only the major differences will be described along with some alternative exercise routines. Where applicable, corresponding parts of the two embodiments of the apparatus will be given similar reference numbers, prefixed with a "200" number series. The three primary differences between the apparatus of FIG. 16 and that of FIG. 1 are: 1) an alternative arm assembly; 2) an alternative partial stabilizer pad mounting assembly; and 3) the frame includes a frame housing (covering the main cabling/pulley assembly) and an additional transverse supporting frame element.

Figure 16:
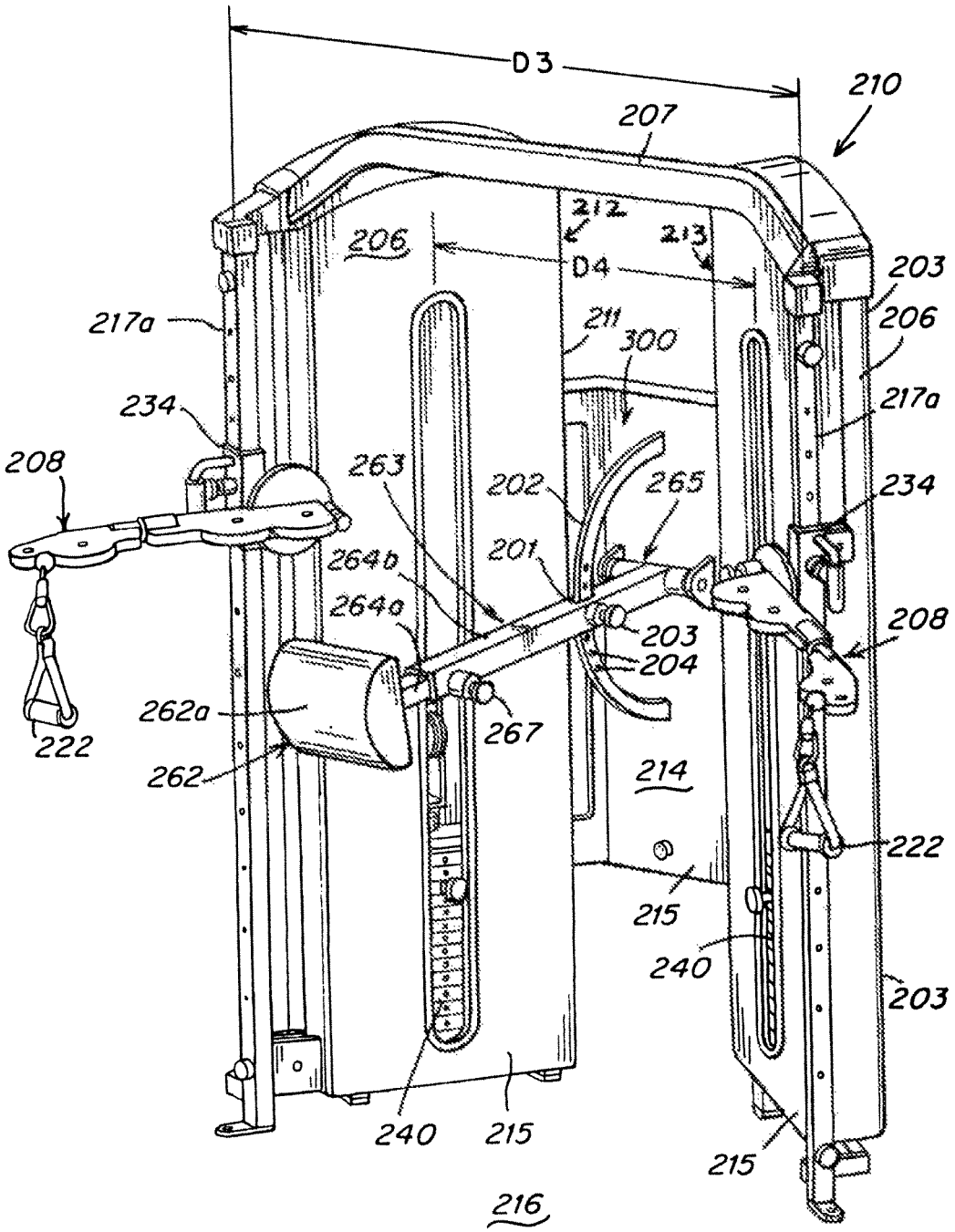
FIG. 16 is a front perspective view of an apparatus according to another embodiment of the invention, showing an alternative handle/arm assembly and partial stabilizer pad mounting assembly, and showing a machine housing covering the cabling and pulley assembly.
Figure 17:
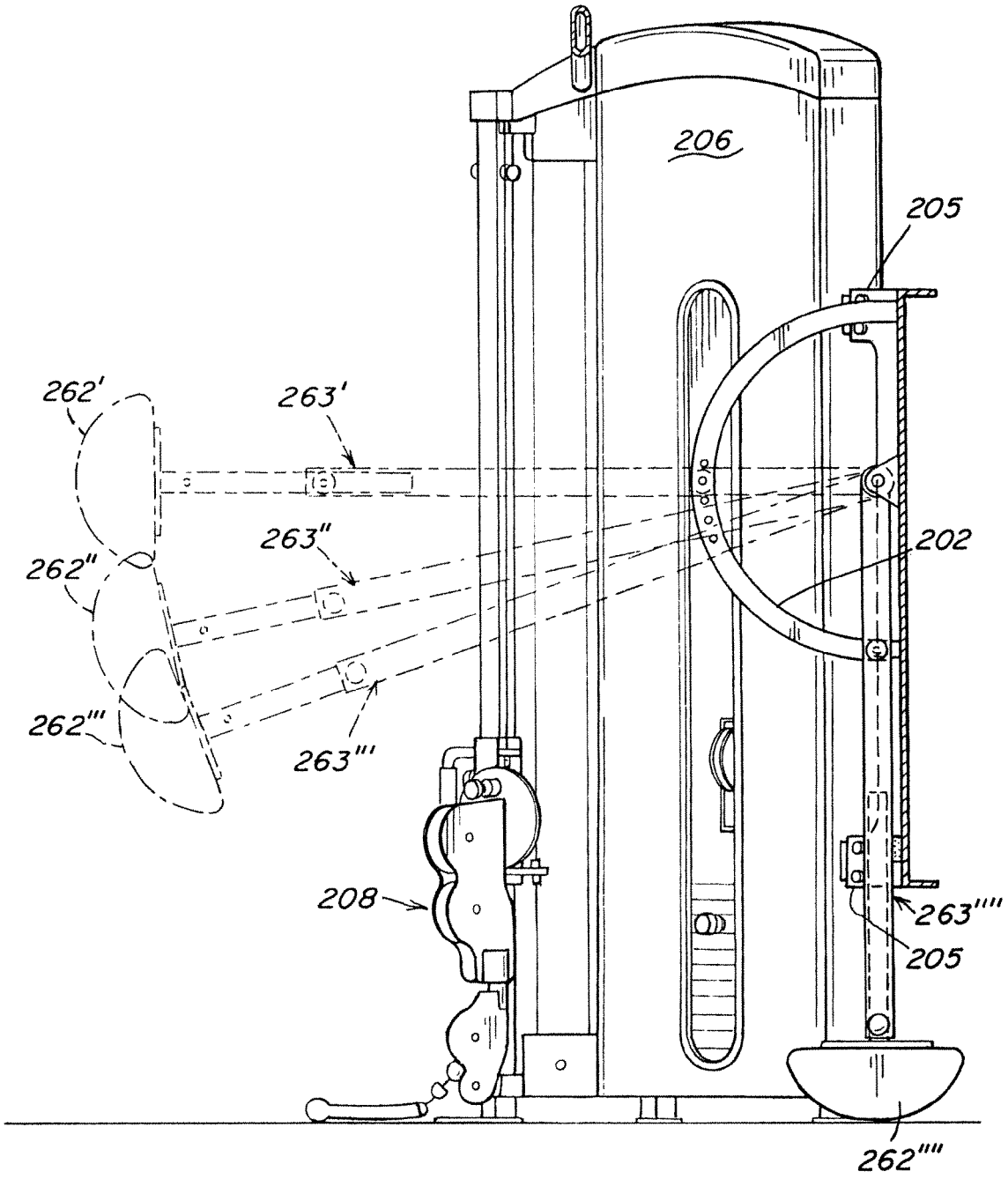
FIG. 17 is a cross-sectional view similar to FIG. 3 but showing various positions of the alternative mounting assembly for the partial stabilizer pad of the apparatus of FIG. 16.
Figure 18:
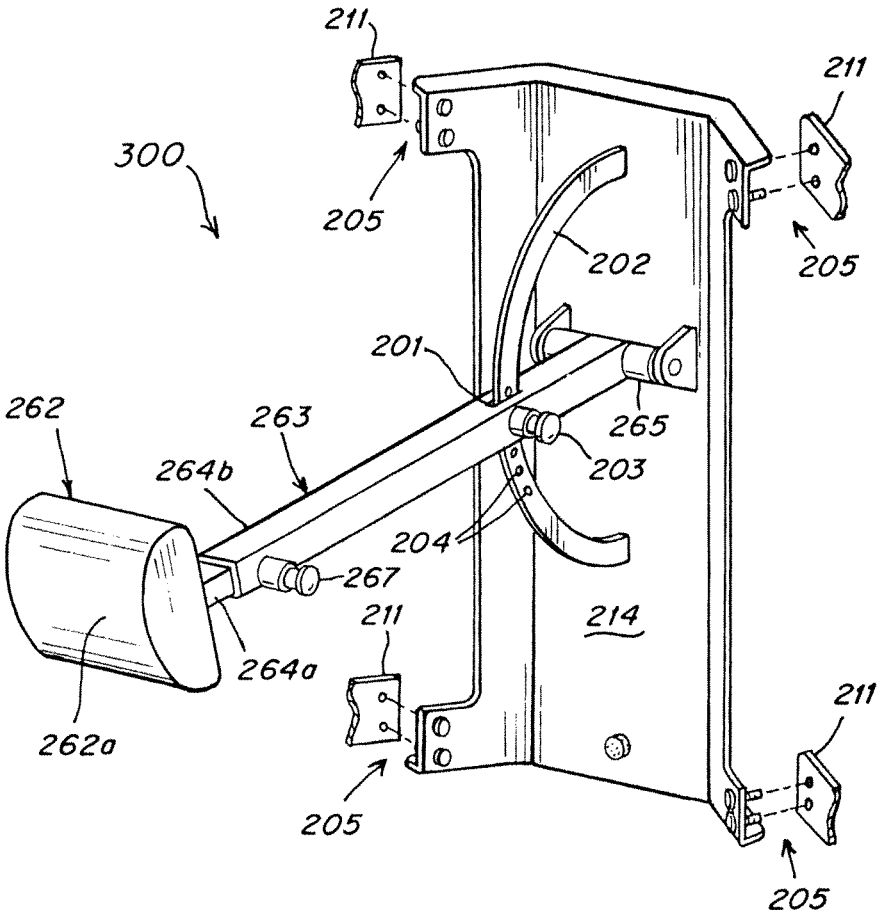
FIG. 18 is an exploded perspective view of the mounting assembly for the partial stabilizer pad of the apparatus of FIG. 16.

FIG. 16 is a front perspective view of the overall apparatus. FIG. 17 is a cross-sectional view, similar to FIG. 3, but showing the alternative positioning of the new mounting assembly for the partial stabilizer pad. FIG. 18 is an exploded perspective view showing the partial stabilizer pad and mounting assembly.

The apparatus of 210 of FIG. 16 includes a similar frame as in the apparatus of FIG. 1, but here the independent cabling/pulley assemblies on the left and right frame elements 212, 213 are shown each encased in an enclosure or housing 206. The housing 206 has an opening to allow access to the weight stack, so that the user can select the desired number of weight plates. The front most frame elements 217 are outside of the housing 206 to enable vertical adjustment of the slider 234 on which is mounted the alternative arm/handle assemblies 208 of this embodiment. An additional transverse support beam 207 extends between and is connected at either end to a top portion of the left and right frame members 211 to further rigidify the apparatus.

The alternative mounting mechanism for the partial stabilizer pad is illustrated in FIGS. 16-18. Instead of the front extender assembly 63 and height extender assembly 70 of the FIG. 1 apparatus, in this embodiment there is a single front extender assembly 263 having first and second telescoping members **264*a* and 264*b*. A partial stabilizer pad 262 similar to that shown in the first embodiment is disposed at the distal end of the first member 264*a*. A proximal end of 264*a* is telescopically positionable inside the distal end of second member 264*b*, and can be locked in position by adjustment pin 267. The proximal end of second member 264*b* has a pivot connector 265 pivotally connected to a rear frame element 214. Here, the rear frame 214 is a rectilinear planar element having angled side edges connected to the opposing left and right frame/housing members 206. The second member 264*b* of the telescoping mounting assembly has a vertical aperture 201 to which there is adjustably positionable a semi-circular arc support member 202 connected on each of its distal ends to the rear frame element 214. The arc element 202 has a plurality of apertures 204 in a front middle section of the arc, e.g. over a circumference of about 45 degrees from an uppermost aperture, in which the second mounting member 264 would be mounted substantially horizontally and parallel to the ground, to a lowermost aperture 45 degrees below the uppermost aperture. A spring biased pin assembly 203 is used for locking the second member 264*b* in one of the apertures 204 for adjusting the height of the partial stabilizer pad 262**.

FIG. 17 shows in dashed lines three alternatives vertical height adjustments of the mounting assembly for the partial stabilizer pad 262. FIG. 17 also shows a collapsed position for the pad, wherein the mounting arms **264*a*, 264*b* extend vertically downwardly, with the pad 262** resting just above the ground. In this position, the pad is out of the way so the user can utilize the apparatus without the pad interfering with such exercise routines.

FIG. 18 shows an exploded component view of the partial stabilizer pad mounting assembly. In each of the four corners of the rear frame element 214, a pair of bolts is used to attach the rear element 214 to each of the side frames 212, 213.

Figure 19:
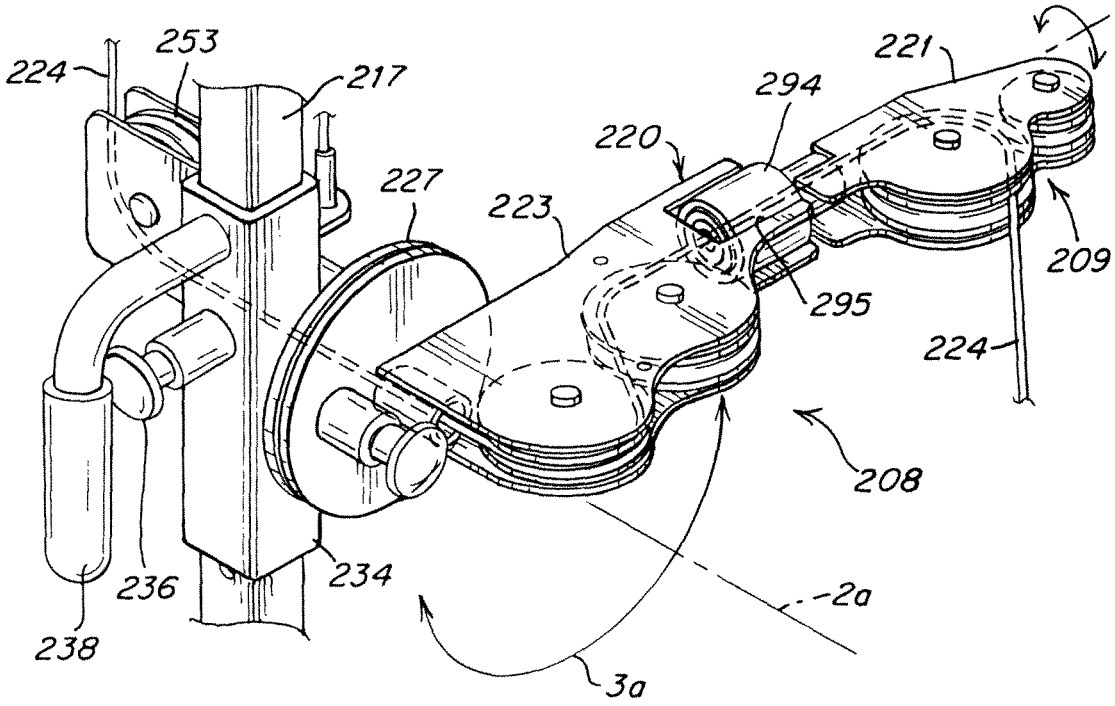
FIG. 19 is a perspective view of the alternative rotating arm embodiment of the apparatus of FIG. 16.
Figure 20:
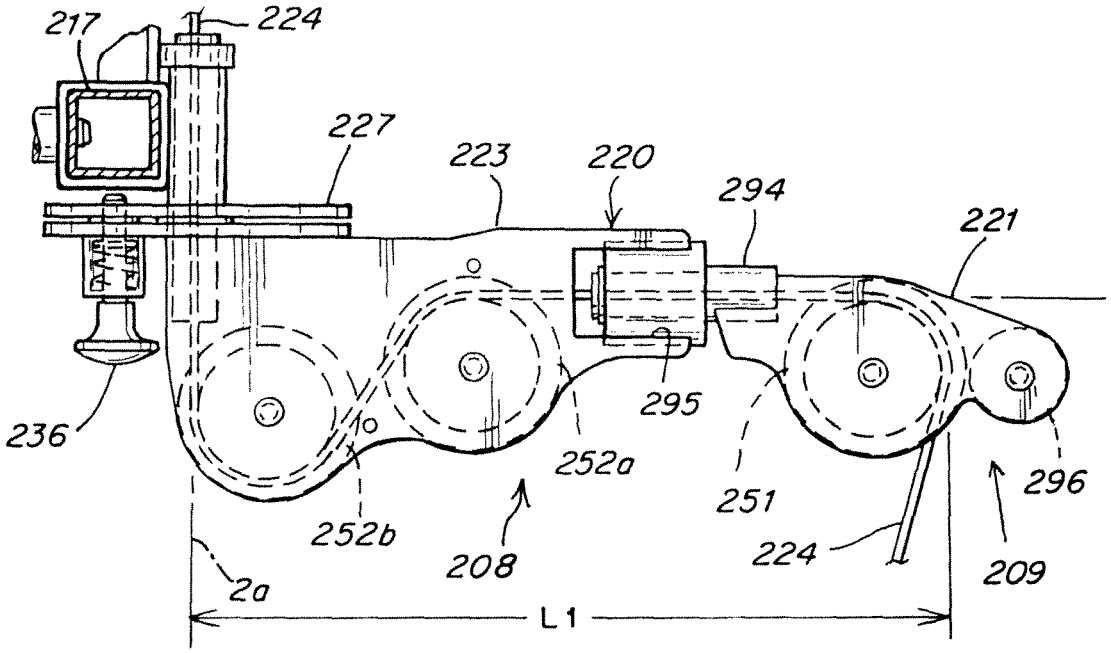
FIG. 20 is a top elevational plan view of the alternative arm embodiment of FIG. 16.

The alternative arm assembly 208 is best illustrated in the sectional views of FIGS. 19-20. An additional pulley has been added to the arm 220, and an alternative swivel mechanism 294 is provided between the distal and proximal arm portions 221, 223. Otherwise, the operation of the arm assembly, and its rotatable connection to the slider on the frontmost frame element 17, is substantially similar to the apparatus shown in FIG. 1.

Whereas the FIG. 1 arm included first and second pulleys 51, 52, the alternative arm assembly of FIGS. 16-24 includes three pulleys labeled 251, **252*a* and 252*b*. The main cable 224 is routed around the three pulleys in arm 220. The three pulleys extend along the axial length L1 of arm 220. The distal end of the main cable 225 extends distally from the distal end 209 of the arm, and again would be prevented from being retracted between first pulley 251 and follower pulley 296 by a stop element (not shown). The distal arm portion 221 and proximal arm portion 223 are connected by a swivel mechanism here illustrated by a cylindrical bearing 294 having a central bore through which the main cable 224 travels, the outer cylindrical surface of bearing 294 is rotatable within a complimentary cylindrical bore 295 in the distal end of proximal arm portion 223. The main cable 224 then travels around pulleys 252*a* and 252*b* of proximal arm portion 223, from which the main cable 224 is then passed through rotatable connector 227 and slider 234 around pulley 253 mounted on slider 234. The main cable then travels the same path around the series of pulleys 54-59 described in the FIG. 1 apparatus, by which the main cable is connected to the weight stack 40. A similar counterbalance weight and cabling assembly is provided for offsetting the weight of arm assembly 208, similar to the apparatus of FIG. 1**.

FIGS. 21-24 show a user performing alternative exercise routines with the apparatus of FIGS. 16. Again, these alternative embodiments are not meant to be limiting, but rather show the versatility of the apparatus.

Figure 21:
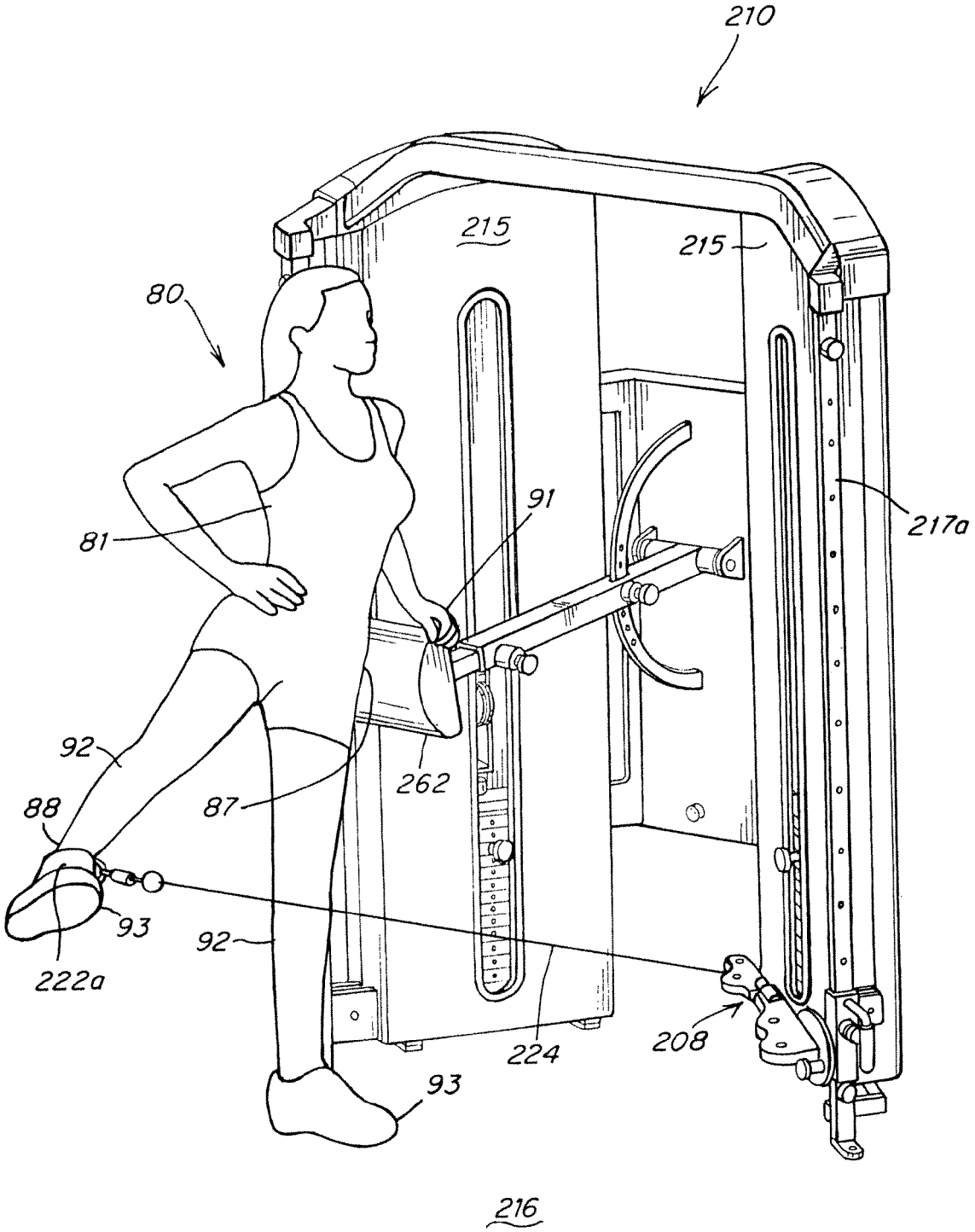
FIG. 21 is a front perspective view of the FIG. 16 apparatus in use, showing one side of a user's torso engaging the partial stabilizer pad at hip level, while performing a leg pulling exercise with an ankle strap wrapped around the user's ankle and connected to the end of the resistance cable.

In FIG. 21, a user 80 is standing upright, with one side of her torso 81 facing the machine 210. The partial stabilizer pad 262 contacts the user's torso at hip 87 level. The user may also, if desired, place one hand 91 on the stabilizer pad to further partially stabilize her torso. However, due to the significant offset between the line of motion of the main cable and the vertical position of the partial stabilizer pad, the user's torso is only partially stabilized and the user must resist the torque generated thus increasing her core body muscular strength. In this embodiment, instead of a handle at the end of the main cable 224, an ankle strap 222*a* is wrapped around the user's ankle 88, and the user pulls outwardly on the resistance cable 224 in a lateral leg extension exercise. The user can then turn and face the opposite direction, and similarly exercise her other leg by attaching the ankle strap to the other handle assembly on the left side of the machine 210.

Figure 22:
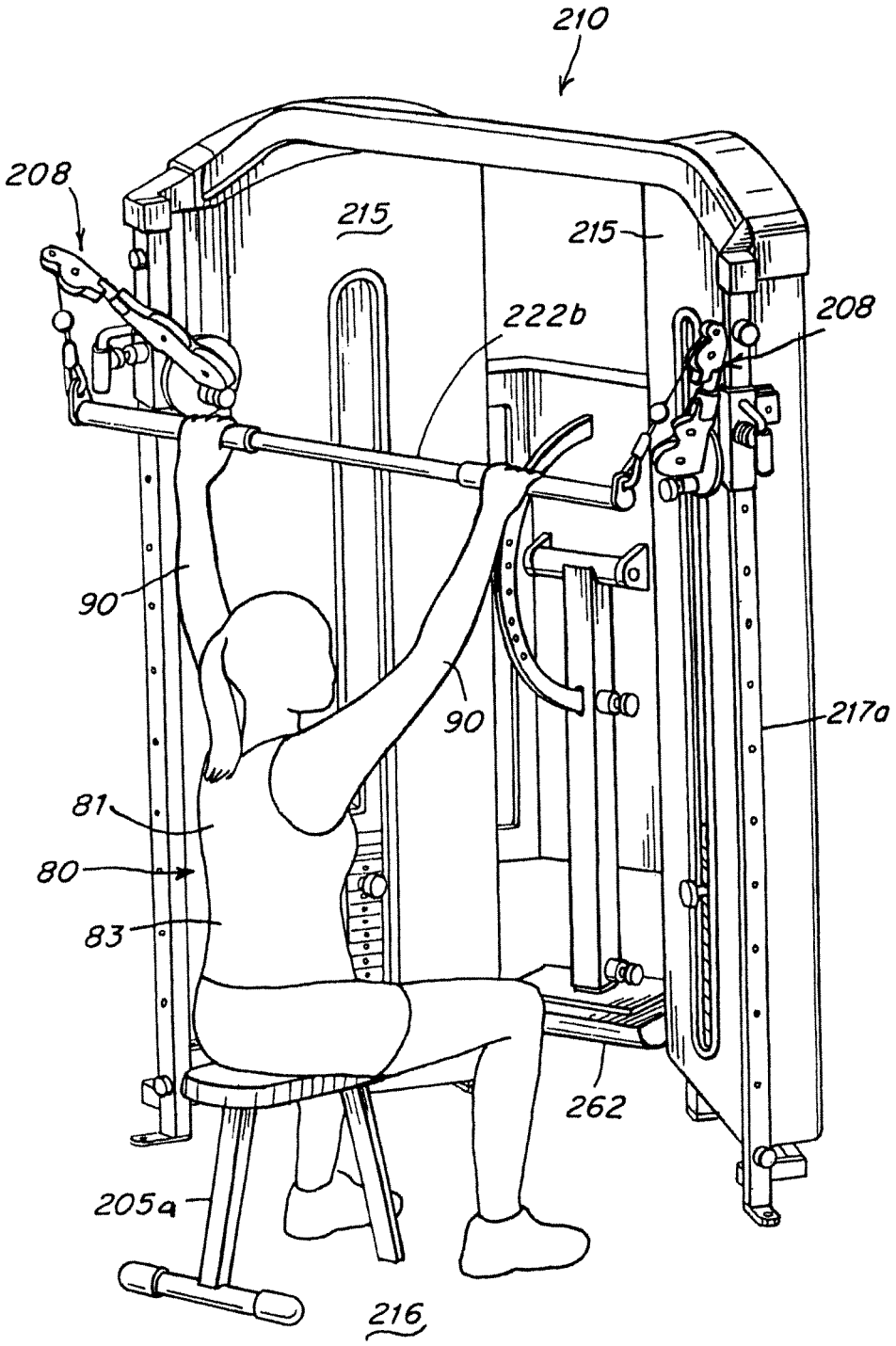
FIG. 22 is a front perspective view of the FIG. 16 apparatus in use, showing a user seated on a bench in front of the apparatus performing a pulling exercise on a bar extending between the two handle/arm assemblies of the machine.

FIG. 22 shows the user 80 seated on a bench 205, which is separate from the apparatus. The bench can be moved conveniently from any spot in the area 216, in front of apparatus 210. Here the user 80 is seated on the bench, facing the machine, and a pulldown bar 222*b* is connected to each of the opposing left and right arm assemblies, instead of a handle. The user grasps opposite ends of the bar with both arms 90 and performs a pulldown exercise. The partial stabilizer pad 262 is not being used, and is shown in the collapsed position so it does not interfere with the exercise routine. Again, this illustrates the versatility of the apparatus in allowing exercises, with or without partial stabilizer pad and with different gripping mechanisms attached to the cable/arm assemblies.

Figure 23:
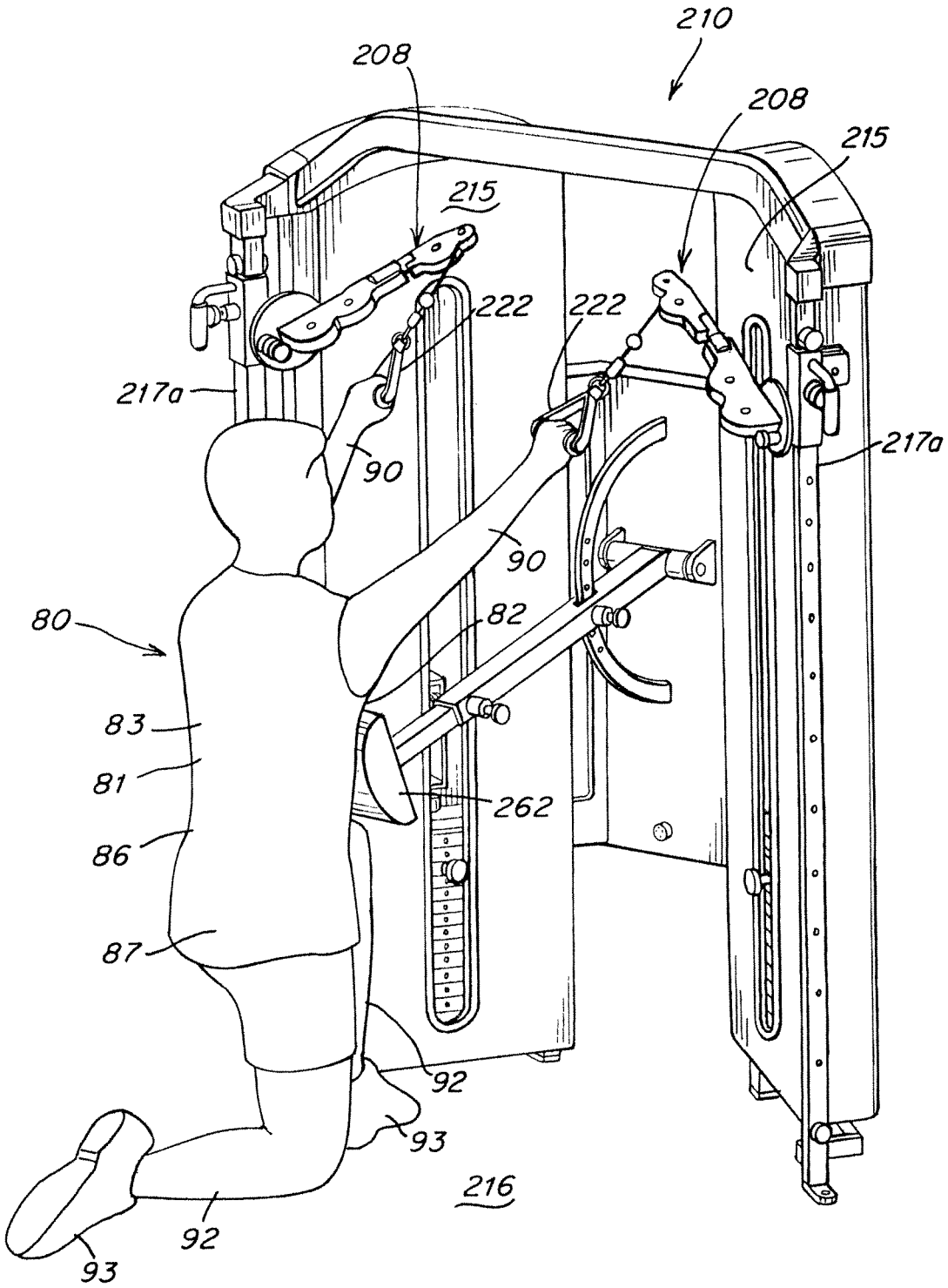
FIG. 23 is a front perspective view of the FIG. 16 apparatus in use, showing a user kneeling on one knee in an upright position in front of the machine with the partial stabilizer pad engaging the front of the user's torso, while the user performs a pulling exercise with both arms each engaging a different one of the two handles.

FIG. 23 illustrates another embodiment of the apparatus in use with the partial stabilizer pad. Here, a user 80 is in an upright posture, kneeling on one knee and facing the machine. The stabilizer pad engages the front of the user's torso 81, below the chest 85 and above the waist 86. The user 80 has both arms 90 extended forwardly, each grasping a different one of the handles 222 attached to the distal ends of the separate arm/cable mechanisms. The user can simultaneously or alternatively pull on the handles. Again, this is a considerable offset between the line of motion established by the user pulling on the handles, as opposed to the vertical position of the stabilizer pad, creating a significant torque which the user's trunk 81 must withstand in order for the user to maintain the upright kneeling position.

Figure 24:
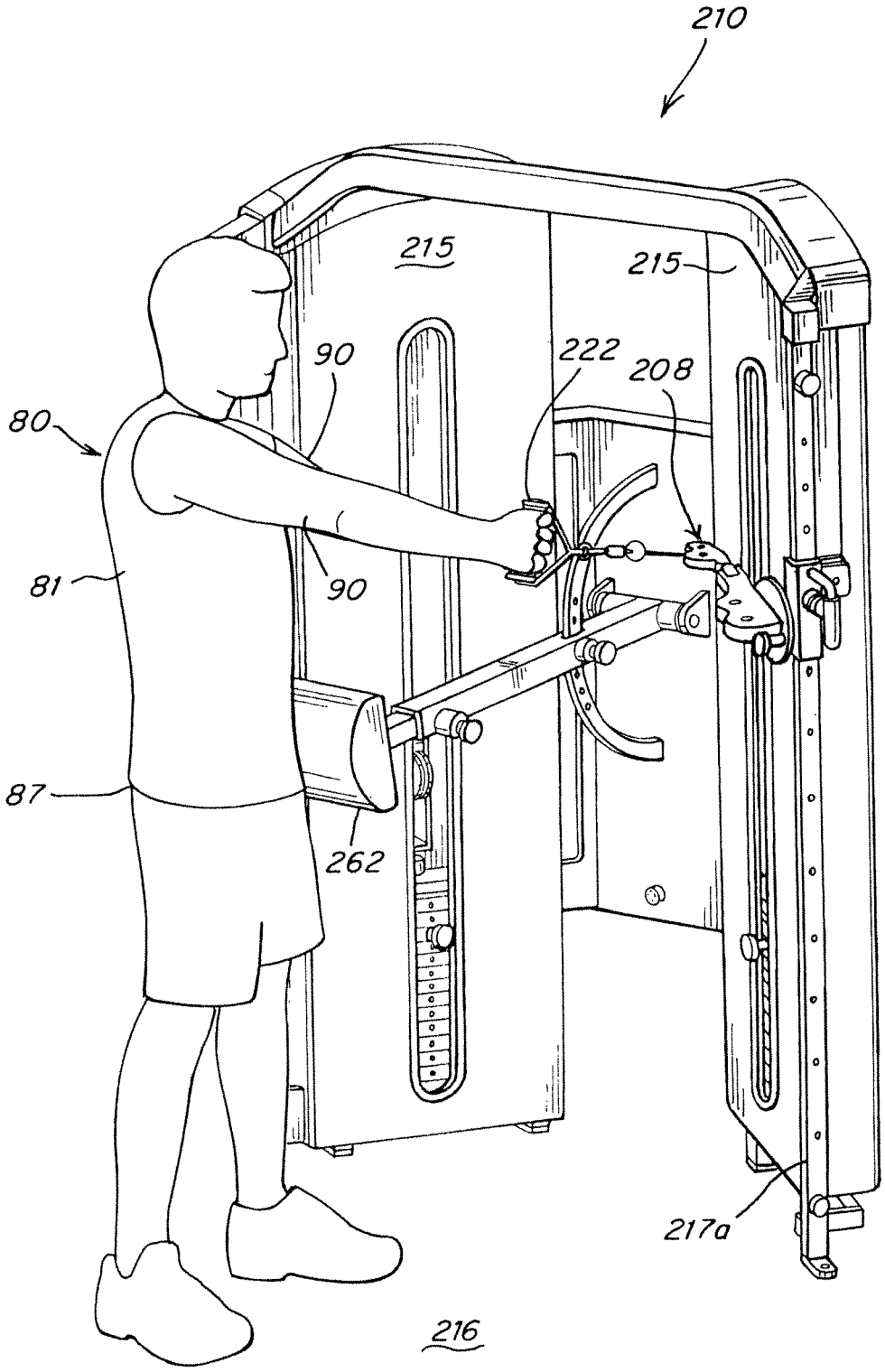
FIG. 24 is a front perspective view of the FIG. 16 apparatus in use, showing a user's side engaging the adjustable stabilizer pad at hip level while standing upright in front of the machine, and performing a pulling exercise with both arms engaging a single handle.

FIG. 24 shows a user 80 positioned generally sideways in front of machine 210. The partial stabilizer pad 262 is positioned against one side of the user's torso 82 at hip 87 level. The user is standing upright and both arms 90 are extended forwardly to grasp the one right handle 222 extending from the right arm/handle assembly 208. The user pulls downwardly on the handle. Again, there is significant torque the user's torso must resist due to the offset between the line of motion established by the user's pulling on the handle versus the position of the partial stabilizer pad.

Returning to FIG. 16 for ease of reference, the frontmost vertical supports 17*a* on which end of the arm/handle assemblies 208 with associated grip members 222 are mounted on/to the frame 211, are disposed a preselected spaced horizontal or lateral distance D3 away from each other. Similarly the two separate weight resistance assemblies 240 are disposed and mounted on/to the frame 211 a spaced horizontal or lateral distance D4 away from each other. As shown, the horizontal and vertical fixed positioning assembly 263, 264*a*, 264*b*, 265, 201, 202, 203, 204, 267 for the stabilization pad 262 is mounted on/to the frame 211 at a position 300 that is disposed horizontally or laterally somewhere between D3 and D4. In the embodiments shown the pad positioning assembly is mounted at a position that is about in the middle of or midway between the horizontal/lateral distances D3 and D4.

The pad 262 preferably has a body part engagement surface area 262*a* that is disposed and faces away from the front face 215 of the machine. There is a back face 203 of the machine that is spaced apart from and opposes the front face. Preferably the body part engagement surface area 262*a* is less than about 0.5 square feet in area and more preferably less than about 0.3 square feet.

The vertical and horizontal fixed positioning assembly on which the pad 262 is mounted, has, as shown mechanisms for adjusting both the fixed vertical and horizontal positions of the pad 262. For example as shown in FIG. 16, the telescoping tube 264*a* within tube 264*b* components primarily enable the pad 262 to be selectively fixedly positioned at a plurality of different horizontal or lateral positions relative to the position of the grips 222 and the arm/handle assemblies 208 generally. Similarly the curved guide rail 202, pivot hinge 265 and slot 201 within tube 263 primarily enable the pad to be selectively fixedly positioned at a plurality of different vertical positions relative the floor or ground on which the user stands or sits as well as relative to the grips 222.

There has thus been described various embodiments of the apparatus and methods of the present invention. Other embodiments and variations will be apparent to the skilled person and are intended to be included within the scope of the appending claims.

The invention claimed is:

1. An exercise apparatus comprising:

a stationary frame;

a resistance cabling system providing a user defined line of motion, the cabling system including at least one handle mounted in a start position and attached to a resistance cable, the handle being grasped in the start position and pulled or pushed by the user to define the line of motion;

a partial stabilizer pad adjustably mounted to the frame for varying the position of the pad with respect to the handle, the pad providing a point of contact for the user's torso so as to partially stabilize the user, the pad being adjustably positionable at multiple vertical positions between the mid-scapular level and hip axis level of the user and arranged on the frame such that the user can grasp the handle in the start position while the pad is positioned and in contact with the user's torso between the mid-scapular and hip axis levels and such that a vertical offset between the line of motion and the point of contact of the pad on the user's torso can be successively increased to increase the torque which the user must resist.

2. The apparatus of claim 1, wherein the pad has a point of contact surface area for engagement with the user's torso of less than about one square foot.

3. The apparatus of claim 1, wherein the handle is mounted on a vertical upright support and is rotatable around a horizontal axis relative to vertical.

4. The apparatus of claim 3, wherein:

the handle is positionable at multiple selected vertical positions on the vertical support enabling the user to define a line of pulling or pushing motion in each selected position.

5. The apparatus of claim 3 wherein the handle is separately fixedly positionable at any one of a multiplicity of selected positions around the horizontal axis.

6. The apparatus of claim 2 wherein:

the frame has a vertically adjustable mounting mechanism for the partial stabilizer pad.

7. The apparatus of claim 6 wherein:

the mounting mechanism extends forwardly from a front face of the frame, and is centrally disposed between two independent handle and resistance cable assemblies.

8. The apparatus of claim 1 wherein the pad is mounted to an arm adapted to adjustably orient the point of contact of the pad in a forwardly facing direction away from the frame.

9. The apparatus of claim 1 wherein:

the at least one handle is rotatably mounted on the apparatus, providing select positioning of the handle around a circumference.

10. The apparatus of claim 1 wherein:

the at least one handle is vertically adjustably positionable on the apparatus.

11. The apparatus of claim 1 wherein:

the at least one handle is rotatably and vertically adjustably positionable on an upright member of the frame.

12. The apparatus of claim 1 wherein the stabilizer pad is adapted to be positionable at multiple vertical positions between the mid-scapular level and hip axis level of the user while the user is in a standing position.

13. A method comprising:

providing an exercise apparatus comprising a resistance cabling system interconnected to a handle having a start position, the apparatus providing a user defined line of motion, and a partial stabilizer pad adapted to provide a point of contact with a user's torso, the pad being adjustably positionable to any one of multiple selectable vertical pad positions that are offset from the line of motion;

the user positioning a select portion of his/her core body against the partial stabilizer pad between a midscapular and hip axis level of the user's body, the user grasping the handle in the start position while the user's body is positioned against the pad and extending the cabling system via the handle to define the user defined line of motion;

the user adjusting the pad to any selected one of the multiple vertical pad positions such that the pad is arranged to engage a selected point of contact of the user's torso between the mid-scapular level and hip axis level and grasping the handle in the start position and while being in contact with the pad to create a vertical offset between the line of motion and the selected point of contact on the user's torso that can be successively increased to successively increase a torque around the selected point of contact depending on the selected vertical position of the pad.

14. The method of claim 13 including:

providing a vertical support along which the handle is adjustable to any one of multiple selectable vertical handle positions; and, the user adjusting the handle to any selected one of the multiple vertical handle positions and grasping the handle while in contact with the pad to create a vertical offset between the line of motion and the point of contact on the user's torso that can be successively increased depending on the selected vertical pad positions and the vertical handle positions.

15. The method of claim 14, including:

providing the handle at multiple selected vertical positions, enabling the user to adjust the amount of offset between the line of motion and the partial stabilizer pad.

16. The method of claim 13, including:

providing a rotatable member connected to the handle, the user rotating the handle and the member to one of multiple fixed selectable rotatable positions to adjust the offset between the line of motion and the stabilizer pad.

17. The method of claim 13, including:

providing a handle positionable in multiple selected vertical positions and multiple selected rotatable positions, wherein the user selects a vertical position and a rotatable position of the handle to adjust the amount of offset between the line of motion and the stabilizer pad.

18. The method of claim 13, including:

the user progressively increasing the amount of offset.

19. The method of claim 13 including the user standing in an upright orientation during the steps of positioning, grasping and extending.

20. An exercise apparatus comprising:

a stationary frame and a floor surface on which the frame is disposed;

a resistance cabling system providing a user defined line of motion, the cabling system including at least one handle having a start position attached to a resistance cable, the stationary frame and the floor surface being arranged such that the handle can be grasped in the start position by the user standing in an upright position on the floor surface forwardly of a rearwardly-disposed portion of the frame and pulled or pushed from the start position to define the line of motion;

a partial stabilizer pad adjustably mounted to an adjustment member on the frame, the adjustment member being adapted to mount the pad in multiple fixed positions forwardly of and in a forwardly facing direction away from the rearwardly-disposed portion of the frame such that the user is disposed in an exercise performance position forwardly of the pad where the user can grasp the handle in the start position, the pad providing a fixed forwardly facing point of contact for the user's torso so as to partially stabilize the user and being arranged on the frame and adjustably positionable via the adjustment member to at multiple fixed vertical positions from the mid-scapular level to hip axis level of a user while the user is simultaneously standing in the upright position, grasping the handle in the start position and in contact with the point of contact of the stabilizer pad between the mid-scapular and hip axis level of the user's torso such that a vertical offset between the line of motion and the point of contact of the pad on the user's torso can be successively increased to increase the torque which the user must resist standing in the upright position.

21. The apparatus of claim 20, wherein the pad has a point of contact surface area for engagement with the user's torso of less than about one square foot.

22. The apparatus of claim 20, wherein the handle is mounted on a vertical upright support and is rotatable around a horizontal axis relative to vertical.

23. The apparatus of claim 22, wherein:

the handle is positionable at multiple selected vertical positions on the vertical support enabling the user to define a line of pulling or pushing motion in each selected position.

24. The apparatus of claim 21, wherein:

the frame has a vertically adjustable mounting mechanism for the partial stabilizer pad.

25. The apparatus of claim 24, wherein:

the mounting mechanism extends forwardly from a front face of the frame, and is centrally disposed between two independent handle and resistance cable assemblies.

26. The apparatus of claim 20, wherein:

the at least one handle is rotatably mounted on the apparatus, providing select positioning of the handle around a circumference.

27. The apparatus of claim 20, wherein:

the at least one handle is vertically adjustably positionable on the apparatus.

28. The apparatus of claim 20, wherein:

the at least one handle is rotatably and vertically adjustably positionable on an upright member of the frame.

29. The apparatus of claim 20, wherein the stabilizer pad is adapted to be positionable at multiple vertical positions between the mid-scapular level and hip axis level of the user while the user is in a standing position.

30. An exercise apparatus comprising:

a stationary frame;

a resistance cabling system providing a user defined line of motion, the cabling system including at least one handle having a start position attached to a resistance cable, the handle being grasped by the user and pulled or pushed from the start position to define the line of motion;

an extender arm having a forward end and a rearward end, the rearward end being pivotally coupled to the frame at a rearwardly-disposed portion thereof;

a partial stabilizer pad adjustably mounted to the forward end of the extender arm and extending forwardly from said rearwardly disposed portion of the frame;

at least one of the extender arm and pad being movable for varying the position of the pad with respect to the handle such that the user can grasp the handle in the start position while the pad is positioned and in contact with the user's torso between a mid-scapular and hip axis level of the user, the pad facing forwardly and providing a forwardly facing point of contact for the user's torso so as to partially stabilize the user against pulling or pushing of the handle and being arranged on the frame and adjustably positionable via the extender arm to at multiple vertical positions between the mid-scapular level and hip axis level of the user such that the user can simultaneously grasp the handle in the start position, dispose the user's torso in contact with the point of contact of the stabilizer pad from the mid-scapular to hip axis levels and increase an offset between the line of motion and the point of contact of the pad on the user's torso to increase the torque which the user must resist.

* * * * *